US005273871A

United States Patent [19]

Takada et al.

[11] Patent Number: 5,273,871

[45] Date of Patent: Dec. 28, 1993

[54] SILVER HALIDE PHOTOGRAPHIC EMULSION AND SILVER HALIDE COLOR PHOTOGRAPHIC LIGHT-SENSITIVE MATERIAL INCORPORATING IT

[75] Inventors: Hiroshi Takada; Sadayasu Ishikawa; Shoji Matsuzaka, all of Hino, Japan

[73] Assignee: Konica Corporation, Japan

[21] Appl. No.: 770,990

[22] Filed: Oct. 1, 1991

[30] Foreign Application Priority Data

Oct. 3, 1990 [JP] Japan ..... 2-265842
Oct. 8, 1990 [JP] Japan ..... 2-269760

[51] Int. Cl.[5] ..... G03C 1/005

[52] U.S. Cl. ..... 430/567; 430/569; 430/503; 430/583; 430/585; 430/599

[58] Field of Search ..... 430/567, 569, 583, 585, 430/599, 503

[56] References Cited

U.S. PATENT DOCUMENTS 4,879,208 11/1989 Urabe ..... 430/569

FOREIGN PATENT DOCUMENTS 264954 4/1988 European Pat. Off. .
0326853 8/1989 European Pat. Off. .
405938 1/1991 European Pat. Off. ..... 430/569
89/06831 7/1989 PCT Int'l Appl. .

OTHER PUBLICATIONS

Patent Abstracts of Japan, vol. 14, No. 551(P-1084)7; Dec. 1990 JPA-2-2350; Sep. 1990.

*Primary Examiner*—Charles L. Bowers, Jr.
*Assistant Examiner*—John A. McPherson
*Attorney, Agent, or Firm*—Jordan B. Bierman

[57] ABSTRACT

A silver halide emulsion comprising a dispersing medium and light-sensitive silver halide grains wherein said silver halide grains each comprise:

(a) a high silver iodide-containing phase having a silver iodide content of not less than 15 mol % in the internal portion, (b) a low silver iodide-containing phase locating outside the phase (a) and having a silver iodide content lower than that of the phase (a), and (c) a surface phase having a silver iodide content higher than that of an inner phase adjacent thereto, and wherein a part or all of the phase (c) and a part or all of the phase (a) or the phase (b) are formed by supplying a fine silver halide grain emulsion prepared in the presence of protective colloid.

14 Claims, No Drawings

SILVER HALIDE PHOTOGRAPHIC EMULSION AND SILVER HALIDE COLOR PHOTOGRAPHIC LIGHT-SENSITIVE MATERIAL INCORPORATING IT

FIELD OF THE INVENTION

The present invention relates to a silver halide emulsion which is useful in the field of photography and a silver halide color photographic light-sensitive material incorporating it. More specifically, the invention relates to a silver halide emulsion which has low fog and high sensitivity and which is excellent in spectral sensitization efficiency, storage stability and developability and a silver halide color photographic light-sensitive material incorporating it.

BACKGROUND OF THE INVENTION

In recent years, there have been increasingly severe demands for the performance of silver halide light-sensitive materials for photographic use. Accordingly, there have been requirements for increased levels of storage stability and photographic properties such as sensitivity, fog and graininess. With the recent popularization of compact zoom cameras and so-called single-use cameras or films with lens, high sensitivity has become an essential feature of photographic light-sensitive materials.

Moreover, sophisticated cameras have permitted ordinary users to easily enjoy various advanced photographic techniques and have accordingly produced new demands for improved sensitivity and improved tone reproducibility under every set of exposure conditions.

Thus, various methods of improving silver halide light-sensitive materials are now under development. As a prior art means of improving the sensitivity of silver halide emulsion, mention may be made of the silver halide emulsion grains of the core/shell type with high inner iodide content characterized by multiple layer-structured grains, disclosed in Japanese Patent Publication Open to Public Inspection (hereinafter referred to as Japanese Patent O.P.I. Publication) No. 14331/1985. This method aims at improving the blue light absorbing efficiency while maintaining high developing activity by covering a low iodide phase (phase having a low silver iodide content; the same applies below), formed inside the grain, with a high iodide phase (phase having a silver iodide content higher than that of the low iodide phase; the same applies below).

However, this method is not expected to be effective on the visible light rays out of the specific absorption band of silver halide, i.e., red light and green light, though it serves to increase the absorption efficiency for the visible light rays in the specific absorption band, namely blue light rays.

It is a common practice to cause a dye called spectral sensitizer to adsorb on silver halide to make a color sensitive material sensitive to red light and green light, which are not absorbed by silver halide grains.

Spectral sensitizing dyes act to absorb the light in a particular wavelength band (sometimes specific absorption) which is not usually absorbed by silver halide and provide the resulting photoelectron for the silver halide. However, if the adsorption between spectral sensitizing dye and silver halide grains is weak, dye desorption may occur during storage of the light-sensitive material (this tendency increases under hot humid conditions), which in turn can degrade the sensitivity. Therefore, enhancing the adsorption between spectral sensitizing dye and silver halide grains not only improves the storage stability but also increases the effective adsorption amount of the sensitizing dye, and is considered to result in an improvement in the light absorption efficiency of the silver halide grains.

As a means of improving spectral sensitizing dye adsorbability and suppressing intrinsic desensitization, the silver iodide content in the grain surface is increased in some known methods. Japanese Patent O.P.I. Publication No. 183646/1989, for example, discloses a light-sensitive material which has high sensitivity and which is less liable to intrinsic desensitization, specifically core/shell type grains having a silver iodide content of not less than 6 mol % in the shell. It is stated therein, however, that the silver iodide content of the core is preferably not more than 5 mol %, more preferably not more than 3 mol % for accelerating the development. Also, the emulsions described in Examples are all comprise core/shell type grains with a low inner iodide content, i.e., this method is limited to core/shell type grains wherein the inner iodide content is low.

On the other hand, Japanese Patent O.P.I. Publication No. 12142/1990 discloses a light-sensitive material which has high sensitivity, which is less liable to intrinsic desensitization and which is less liable to pressure/stress fogging, specifically silver halide grains which have an outermost shell whose silver iodide content is higher than that of the core at not less than 6 mol %, at least one intermediate shell between the core and the outermost shell and an aspect ratio of lower than 8. As is obvious to those skilled in the art and as stated in the specification for that patent, grains having a high surface silver iodide content are undesirable for use as a photographic light-sensitive material for color negative films, since the progression of development is considerably retarded. This is because the iodide in the grain surface region suppresses development, since color development is of surface development.

However, the data on the evaluation of the sensitivity and intrinsic desensitization in Examples does not reflect the performance of the color light-sensitive material, since black-and-white development, which is hardly affected by development suppression by iodide, is used. In addition, in the color development, evaluation data was obtained for intrinsic sensitivity alone, since the spectral sensitizing dye was not adsorbed. Moreover, no comparison was made with core/shell type grains having a high inner iodide content in this case.

As stated above, none of the conventional color photographic light-sensitive materials incorporating an emulsion of core/shell type grains having a low inner iodide content offers satisfactory improvement in sensitivity or fog reduction.

Japanese Patent O.P.I. Publication No. 106745/1988 discloses a light-sensitive material which is excellent in spectral sensitizing property and which is not liable to performance deterioration under humid conditions, specifically core/shell type grains having a high inner iodide content and a surface silver iodide content of not less than 5 mol %. The specification for that patent describes a method of introducing silver iodide to the grain surface wherein fine silver iodide grains of not more than 0.1 μm or fine silver halide grains having a high silver iodide content are added. However, the introduction of silver iodide to the grain surface in Examples is always achieved using the double jet method or an aqueous solution of potassium iodide. In addition, there is no description of a method of forming the core and shell using fine silver halide grains; in Examples, silver halide grains are prepared by the controlled double jet method.

This method does not offer a satisfactory effect, since the degrees of improvement in the sensitivity, color sensitizing property and storage stability are low.

When a silver halide photographic light-sensitive material is subjected to exposure at high intensity for a short time or at low intensity for a long time, the obtained image density is rarely constant even when the amounts of exposure are equal to each other. Such changes in sensitivity and tone depending on exposure intensity is referred to as the reciprocity law failure. The reciprocity law failure occurring in high intensity exposure relative to optimum exposure conditions is referred to as high intensity reciprocity law failure, and the reciprocity law failure occurring in low intensity exposure is referred to as low intensity reciprocity law failure.

In a light-sensitive material with a significant reciprocity law failure, the exposure time must be corrected according to the illuminance and light source. When the layers of a multiple layered color light-sensitive material have different degrees of reciprocity law failure, the obtained image shows color fluctuation according to exposure time.

To improve this reciprocity response, various methods of improving silver halide light-sensitive materials are under development. The prior art of improving the reciprocity response of silver halide emulsions is based mainly on silver halide grains doped with ions of metals primarily those belonging to the group VIII in the periodic table of elements. Japanese Patent O.P.I. Publication Nos. 184740/1988, 183647/1989 and 183655/1989, for example, disclose methods of improving the reciprocity response by doping with ruthenium and iridium ions, iron ion and rhodium ion, respectively.

However, these methods based on metal ion doping are not expected to have an effect on the low intensity reciprocity law failure, and its improving effect on the high intensity reciprocity law failure property is not satisfactory. Moreover, sensitivity reduction and increased fog pose other problems.

International Application No. 06831/1989 discloses a silver halide light-sensitive material which has high sensitivity and which is less liable to fogging, specifically reduction-sensitized silver halide grains wherein crystals were grown in the presence of fine silver halide grains. It is evident from the description of the objects and effect of the method in the specification, however, that this method does not meet the structural requirement of the present invention to have an improving effect on the reciprocity law failure property.

Also, Japanese Patent O.P.I. Publication No. 222939/1990 discloses a silver halide photographic light-sensitive material which has high sensitivity, especially in the spectrally-sensitizing range, and which is less liable to fogging, specifically silver halide grains containing not less than 5 mol % silver iodide on the grain surface which has been reduction sensitized during their growth. However, the silver halide grains described in Examples are core/shell type grains having a high inner iodide content wherein the silver iodide content of the shell has been increased to not less than 5 mol %, which are totally different from the silver halide grains of the present invention. In addition, this method does not offer an improvement in the reciprocity law failure property.

As stated above, there is no prior art method which offers high sensitivity and suppressed fog and which makes it possible to improve the reciprocity response.

SUMMARY OF THE INVENTION

It is an object of the present invention to provide a silver halide emulsion which is less liable to fog, which has high sensitivity and which is excellent in spectrally-sensitizing efficiency, storage stability and developability.

It is another object of the present invention to provide a silver halide color photographic light-sensitive material which has high sensitivity, which is less liable to fogging, which has an improved reciprocity response and which is excellent in storage stability and developability.

The present inventors made investigations and found that the objects of the invention described above can be accomplished by a silver halide emulsion characterized as follows and a silver halide color photographic light-sensitive material containing said emulsion as a component thereof, and thus developed the invention.

Accordingly, the present invention comprises a silver halide emulsion comprising a dispersant and a light-sensitive silver halide grains wherein said silver halide grains have:

(a) at least one high silver iodide-containing phase with a silver iodide content of not less than 15 mol % in the internal portion of the grain, (b) at least one low silver iodide-containing phase whose silver iodide content is lower than that of the high silver iodide phase, and which is outside the high silver iodide phase and (c) a phase on the surface of the grains whose silver iodide content is higher than that of the inner phase adjacent thereto, and wherein a part or all of the phases (c) and (a) and/or (b) are formed by supplying an emulsion comprising fine silver halide grains formed in an aqueous solution of protective colloid, and a silver halide color photographic light-sensitive material comprising a support and at least one red-sensitive layer, one green-sensitive layer and one blue-sensitive layer formed thereon, all of which contain a chemically and/or spectrally sensitized silver halide emulsion wherein at least one of said emulsion layers contains the silver halide emulsion described above.

In general, the adsorption of spectral sensitizing dye to silver halide grains often increases as the silver iodide content of the grain surface increases. Moreover, the sensitivity reduction in the intrinsic absorption band (intrinsic desensitization), which occurs when a sensitizing dye is adsorbed to silver halide grains, can also be improved by increasing the silver iodide content of the grain surface.

On the other hand, the sensitizing efficiency in chemical sensitization (normally gold or sulfur sensitization) is known to depend on the silver iodide content of the grain surface. In other words, when the surface silver iodide content is high, the $Ag_2S$ clusters formed disperse themselves to reduce the latent image formation efficiency. In addition, when the silver iodide content of the grain surface is high, development is suppressed by iodide and the developability deteriorates considerably.

In other words, there is a competing requirement between chemical sensitization applicability/developability and dye adsorbability with respect to the silver iodide content of the silver halide grain surface. Thus, in the prior art method aiming at improving the dye adsorbability by solely increasing the silver iodide content of the outermost shell of silver halide grains, a sufficient sensitivity cannot be obtained, since the loss of the chemical sensitization applicability and developability exceeds the benefit from improvement in the dye adsorbability.

On the other hand, the silver halide grains of the present invention are considered to simultaneously improve the chemical sensitizability/developability and dye adsorbability, which bear reverse relationships with the grain surface silver iodide content, by the configuration described above to lead to the accomplishment of the objects of the invention, but the action mechanism involved remains to be clarified. In this regard, the inventors speculate as follows.

If the surface of silver halide grains is uniform in composition, a spectral sensitizing dye can be uniformly adsorbed thereto. As the uniformity of dye adsorption increases, the light absorption efficiency of silver halide grains increases to ensure sensitization.

In the methods of preparing silver halide grains wherein an aqueous solution of silver salt and an aqueous solution of halide are added to an aqueous solution of colloid in the reactor, typically represented by the double jet method, it is difficult to prepare uniform silver halide grains because the concentrations of silver and halide ions increase in the vicinities of the site of addition of each reaction solution. In the high silver ion concentration region, for example, this localized distribution of ion concentrations results in the formation of reduced silver or fogged silver and causes aggravated fog. When a silver iodobromide phase is formed, the distribution of silver iodide content in the high halide ion concentration region becomes ununiform among and within grains.

In the method aiming at increasing the silver iodide content of the grain surface by forming core/shell type grains with a high inner iodide content by the double jet method and allowing the inner iodide to bleed out or by halide-conversion reaction in the presence of potassium iodide added after grain formation, as in Examples in Japanese Patent O.P.I. Publication No. 106745/1988, the silver halide distribution in the surface region cannot be uniformized. Thus, the use of this method to increase the areal coverage by dye and enhance the adsorption requires a sufficiently high silver iodide content of the grain surface, which results in degraded chemical sensitization applicability and developability.

On the other hand, the silver halide grains of the present invention, formed by supplying fine silver halide grains, have a very uniform structure, involving very little unevenness due to the presence of a localized high ion concentration region. This uniformness is found in the grain surface region as well.

Therefore, the coverage by dye is very high, since the spectral sensitizing dye can be uniformly adsorbed onto the grain surface, and the silver iodide content of the grain surface is uniformly high; these features ensure excellent adsorptivity.

When fine silver halide grains are used to form a phase on the surface (hereinafter referred to as surface phase) with high silver iodide content in mother grains, the uniformity of the surface phase depends on the uniformity of the mother grains. In other words, the degree of uniformness of the surface phase formed decreases as the degree of uniformness of the mother grains decreases. It is therefore difficult to form a surface phase having a uniformly high silver iodide content distribution in grains with ununiform halide composition like the core/shell grains formed by the double jet method even when fine silver halide grains are supplied. The influence of ununiformness of the mother grains cannot be eliminated unless the surface phase is thickened. However, thickening of the surface phase with high silver iodide content should always deteriorate the developability. Thus, to form a surface phase having a uniformly high silver iodide content without spoiling the developing activity, the silver halide mother grains must be more uniform. The present invention is considered to make it possible to form a very uniform grain surface by increasing the uniformness in the inner portion of the grains.

To summarize, the present invention makes it possible to minimize the silver iodide content and thickness of the phase having a high silver iodide content by forming it very uniformly on the surface of silver halide grains having a high silver iodide phase therein and a low silver iodide phase outside the high silver iodide phase, which not only significantly improves the light absorption efficiency by increased adsorption and coverage of sensitizing dye but also improves the developability and chemical sensitization applicability in comparison with the prior art methods.

The present invention is hereinafter described in more detail.

DETAILED DESCRIPTION OF THE INVENTION

The silver iodide content of the high silver iodide phase is preferably not less than 15 mol %, more preferably 20 to 45 mol %, and still more preferably 25 to 40 mol %. The volume of the high silver iodide phase preferably accounts for 3 to 80 mol %, more desirably 5 to 60 mol %, and still more desirably 10 to 45 mol % of the entire grain.

The silver iodide content of the low silver iodide phase formed outside the high iodide phase is normally lower than the silver iodide content of the high iodide phase, preferably not more than 15 mol %, more preferably not more than 10 mol %, and still more preferably not more than 5 mol %. The volume of the low silver iodide phase preferably accounts for 3 to 70 mol %, more preferably 5 to 50 mol % of the entire grain.

It is preferable that there be a difference of not less than 5 mol %, more preferably not less than 10 mol % between the silver iodide contents of the high and low iodide phases.

There may be another silver iodide phase (intermediate phase) between the high and low iodide phases. In this case, the intermediate phase preferably has a silver iodide content lower than that of the high iodide phase and higher than that of the low iodide phase. The volume of the intermediate phase preferably accounts for 5 to 70 mol %, more preferably 10 to 65 mol % of the entire grain.

In the mode of embodiment described above, there may be still another silver halide phase in the inner high silver iodide phase, between the high silver iodide phase and the intermediate phase and between the intermediate phase and the low silver iodide phase.

The surface phase of the silver halide grains of the present invention normally has a silver iodide content higher than that of the inner phase adjacent thereto, but it is preferable that the silver iodide content is higher by not less than 2 mol %, more preferably not less than 3 mol %, and still more preferably not less than 5 mol % than that of the adjoining inner phase. The volume of the surface phase preferably accounts for not more than 35%, more preferably not more than 25%, and still more preferably not more than 15% of the entire grain.

The "surface phase" mentioned in the present invention means a structural phase located in the outermost portion of the silver halide composition of the grains. In the present invention, the surface phase does not necessarily cover the entire surface of mother grains for the formation thereof; the desired effect of the invention can be obtained, as long as at least a part of the surface of mother grains is covered with the surface phase, but it is preferable that not less than 50%, more preferably not less than 60%, and still more preferably not less than 70% of the surface of mother grains be covered with the surface phase.

The inner phase adjacent to the surface phase may be the low iodide phase or not. In other words, there may be another silver iodide phase (intermediate phase) between the inner phase adjoining the surface phase and the low iodide phase. In this case, the volume of the intermediate phase preferably accounts for not more than 70 mol %, more preferably not more than 30 to 60 mol % of the entire grain.

In the modes of embodiment described above, the silver halide grains of the present invention are formed by the method in which a part or all of the surface phase and a part or all of the high iodide phase and/or low iodide phase are formed by supplying fine silver halide grain emulsion (hereinafter also referred to as the fine grain supply method). It is preferable to form a part or all of the surface phase and low iodide phase by the fine grain supply method.

It is preferable that a part or all of the surface phase and low and high iodide phases, still more preferably a part or all of the phases which constitute the grains, be formed by the fine grain supply method. In the modes of embodiment described above, it is also preferable that not less than 40%, more preferably not less than 60%, and still more preferably not less than 80% of each phase be formed by the fine grain supply method. It is most preferable to form all of the phase by the fine grain supply method.

There are two methods of forming silver halide grains by supplying fine silver halide grains: the method in which nothing other than fine grains of silver halide are supplied, and the method in which an aqueous solution of halide or silver salt is also supplied, as described in Japanese Patent O.P.I. Publication No. 167537/1990. For increasing the uniformness of silver halide grains, it is preferable to use the method in which nothing other than fine grains of silver halide are supplied.

The method of forming the surface phase of silver halide grains of the present invention is not subject to limitation except that a part or all of the surface phase is formed using fine silver halide grains. For example, to obtain a surface phase having a silver iodide content higher than that of the inner phase adjacent to the surface phase, fine silver halide grains having the desired silver iodide content may be used. Also, fine silver iodide grains may be used singly or in combination with fine silver halide grains having a different silver halide composition to obtain the desired silver iodide content. The formation of the surface phase may follow the formation of silver halide mother grains therefor or follow the preparation of mother grains (e.g., after desalting or washing or before, during or after chemical sensitization). A crystal habit modifier may be used to localize the high silver iodide surface phase in a particular site on the surface of mother grains.

The surface phase may be formed at a time or in several stages.

The silver halide grains of the present invention may have any silver halide composition, as long as silver iodide is contained therein. For example, the modes of embodiment of the invention described above comprise any composition, including silver iodobromide, silver chloroiodide, silver chloroiodobromide or a mixture thereof, with preference given to silver iodobromide.

The silver halide emulsion of the present invention preferably comprises silver iodobromide having an average silver iodide content of 1 to 20 mol %, more preferably 4 to 15 mol %.

In the present invention, when the silver halide grain surface phase is over about 50 Å in thickness, the silver iodide content of the surface phase can be determined by the XPS method.

The XPS method is described below.

Prior to determination by the XPS method, the emulsion is pre-treated as follows. First, a pronase solution is added to the emulsion, followed by gelatin decomposition with stirring at 40° C for 1 hour. Then, centrifugation is conducted to precipitate the emulsion grains. After removing the supernatant, an aqueous solution of pronase is added, followed by further gelatin decomposition under the same conditions as above. The sample thus treated is re-centrifuged. After removing the supernatant, distilled water is added to re-disperse the emulsion grains therein, followed by centrifugation and supernatant removal. After three cycles of this washing procedure, the emulsion grains are re-dispersed in ethanol. The resulting dispersion is thinly applied over a mirror-polished silicon wafer to yield a subject sample.

Determination by the XPS method is made using, for example, the ESCA/SAM560 model spectrometer, produced by PHI Co., under conditions of Mg-Kα ray as the excitation X-ray, 15 KV of X-ray source voltage, 40 mA of X-ray source current and 50 eV of pass energy.

To determine the surface halide composition, Ag3d, Br3d and I3d3/2 electrons are detected. Composition ratio is calculated from the integrated intensity in each peak by the relative sensitivity coefficient method. The composition ratio is obtained as a percent ratio of atomic number using relative sensitivity coefficients of 5.10, 0.81 and 4.592 for Ag3d, Br3d and I3d3/2, respectively.

In the ordinary determination by the XPS method as described above, the measuring probe X-ray enters in the sample to a depth of about 50 Å. It is therefore difficult to accurately determine the silver iodide content of the surface phase by the ordinary XPS method when the thickness of the silver halide grain surface phase of the invention is less than 50 Å in thickness. Even in such a case, however, the silver halide grains can be regarded as of the present invention when their silver halide compositional structure has a surface phase whose silver iodide content is higher than that of the adjoining inner phase.

When the surface phase of silver halide grains is less than 50 Å in thickness, its silver iodide content can be determined by, for example, Auger electron spectroscopy or the angular resolution XPS method, in which the measuring probe is obliquely inserted in the sample to make its entrance in the sample shallower in the direction of the thickness of the sample.

To determine the compositional structure of silver halide grains, the following means, for example, can be used. In accordance with the method of Inoue et al. described in the proceedings of a meeting of the Society of Photographic Science and Technology of Japan, pp. 46–48, silver halide grains are dispersed and solidified in methacryl resin, after which they are prepared as ultrathin sections using a microtome. The sections having a cross sectional area of over 90% of the maximum cross sectional area are selected. The silver iodide content and distribution are determined by the XMA method on the straight line drawn from the center to outer periphery of the least circumcircle with respect to the cross section, whereby the silver iodide content structure of the grains can be obtained.

The XMA method (X-ray microanalysis) is described below. Silver halide grains are dispersed in an electron microscopic grid on an electron microscope in combination with an energy dispersion type X-ray analyzer, and magnifying power is set so that a single grain appears in the CRT field under cooling with liquid nitrogen. The intensities of AgL$\alpha$ and UK$\alpha$ rays are each integrated for a given period. From the IL$\alpha$/AgL$\alpha$ intensity ratio and the previously drawn working curve, the silver iodide content can be calculated.

X-ray diffraction can be used to examine the structure of silver halide grains. The X-ray diffractiometry is briefly described below.

As the X-ray irradiation source, various characteristic X-rays can be used, of which CuK$\alpha$ ray, wherein Cu is the target, is most commonly used.

Since silver iodobromide has a rock salt structure and since its (420) diffraction line with CuK$\alpha$ ray is observed with relatively intense signal at a high angle of $2\theta=71$ to 74°, it is most suitable as a subject of crystalline structural determination with high resolution.

In measuring the X-ray diffraction of photographic emulsion, it is necessary to remove the gelatin, mix a reference sample such as silicon and use the powder method.

The determination can be achieved with reference to "Kiso Bunseki Kagaku Koza", vol. 24, "X-ray Analysis", published by Kyoritsu Shuppan.

In the present invention, the grain size of the fine silver halide grains supplied during formation of light-sensitive silver halide grains is preferably not more than 0.1 μm, more preferably not more than 0.05 μm, and still more preferably not more than 0.03 μm. The grain size of fine silver halide grains can, for example, be obtained by measuring the diameter of grains magnified at 30000 to 60000 folds on an electron micrograph or the area of projected image.

The fine grains to be supplied may be prepared (a) in advance of, or (b) concurrent with, the formation of the light-sensitive silver halide grains.

In the case of (b), the increase in the size of fine grains due to Ostwald ripening among the fine grains can be suppressed, since the retention time from nucleation to addition of the fine silver halide grains. It is preferable to continuously supply fine silver halide grains while preparing them, since this practice effectively shortens the retention time.

The fine silver halide grains supplied is not subject to limitation with respect to the silver halide composition or the number of its kinds; for example, (1) fine silver halide grains having a silver halide composition according to the desired halide composition of the silver halide grains may be used, or (2) two or more kinds of fine silver halide grains having different silver halide compositions may be supplied simultaneously or separately with a mixing ratio according to the desired halide composition of the silver halide grains.

Although the above conditions (a) and (b) and (1) and (2) may be used in any combination, it is preferable from the viewpoint of productivity to use the fine grain supply method (a) in combination with (2).

It is important for improving the solubility of fine grains to reduce the size of the fine grains to be supplied.

By using a sparingly gelable dispersant as a protective colloid during preparation of fine grain, it is possible to lower the fine grain preparation temperature and thus further reduces the size of fine grains.

In this context, the "sparingly gelable dispersant" for the present invention means a dispersant of (A) low molecular gelatin, (B) synthetic polymeric compound or natural polymeric compound other than gelatin which is less liable to gel or solidify than common photographic gelatin (average molecular weight of over 70000) and which serves as a protective colloid on silver halide grains. More specifically, the low molecular gelatin is a gelatin having an average molecular weight of not more than 50000, preferably 500 to 30000, and still more preferably 1000 to 20000.

A low molecular gelatin for the present invention can be prepared as follows. Ordinary photographic gelatin having an average molecular weight of about 100000 is dissolved in water, and gelatinase is added to enzymatically decompose the gelatin molecules. This method can be performed in accordance with "Photographic Gelatin", R. J. Cox, Academic Press, London, 1976, pp. 233–251 and 335–346. This method is preferable, since it is possible to obtain a low molecular weight with a relatively narrow molecular weight distribution because the bonding site where enzymatic decomposition occurs is known, and since the molecular weight can be adjusted on the basis of enzymatic decomposition time (the molecule weight decreases with time). Other available methods include the hydrolytic method in which gelatin is hydrolyzed under heating at low (1 to 3) or high (10 to 12) pH levels, and the method in which the crosslinkages are broken by ultrasonication. In addition to the ordinary gelatin, denatured gelatin etc. may be used. The molecular weight distribution and average molecular weight of gelatin can be determined by an ordinary method such as gel permeation chromatography (GPC) or coacervation.

(B) Synthetic Polymeric Compounds a. Polyacrylamide polymers

Examples include acrylamide homopolymers, the polyacrylamide/imidated polyacrylamide copolymer described in U.S. Pat. No. 2,541,474, the acrylamide-methacrylamide copolymer described in German Patent No. 1,202,132, the partially amidated acrylamide polymer described in U.S. Pat. No. 3,284,207 and the substituted acrylamide polymers described in Japanese Patent Examined Publication No. 14031/1970, U.S. Pat.

Nos. 3,713,834 and 3,746,548 and British Patent No. 788,343.

b. Amino polymers

Examples include the amino polymers described in U.S. Pat. Nos. 3,345,346, 3,706,504 and 4,350,759 and German Patent No. 2,138,872, the polymers having a quaternary amine described in British Patent No. 1,413,125 and U.S. Pat. No. 3,425,836, the polymer having an amino group and carboxyl group described in U.S. Pat. No. 3,511,818 and the polymer described in U.S. Pat. No. 3,832,185.

c. Polymers having a thioether group

Examples include the polymers having a thioether group described in U.S. Pat. Nos. 3,615,624, 3,860,428 and 3,706,564.

d. Polyvinyl alcohols

Examples include vinyl alcohol homopolymers, the organic acid monoester of polyvinyl alcohol described in U.S. Pat. No. 3,000,741, the maleate described in U.S. Pat. No. 3,236,653 and the polyvinyl alcohol/polyvinylpyrrolidone copolymer described in U.S. Pat. No. 3,479,189.

e. Acrylic acid polymers

Examples include acrylic acid homopolymers, the acrylate polymer having an amino group described in U.S. Pat. Nos. 3,832,185 and 3,852,073, the halogenated acrylate polymer described in U.S. Pat. No. 4,131,471 and the cyanoalkylacrylate described in U.S. Pat. No. 4,120,727.

f. Polymers having hydroxyquinoline

Examples include the polymers having hydroxyquinoline described in U.S. Pat. Nos. 4,030,929 and 4,152,161.

g. Cellulose and starch

Examples include the cellulose or starch derivatives described in British Patent Nos. 542,704 and 551,659 and U.S. Pat. Nos. 2,127,573, 2,311,086 and 2,322,085.

h. Acetals

Examples include the polyvinyl acetals described in U.S. Pat. Nos. 2,358,836, 3,003,879 and 2,828,204 and British Patent No. 771,155.

i. Polyvinylpyrrolidones

Examples include vinylpyrrolidone homopolymers and the acrolein-pyrrolidone copolymer described in French Patent No. 2,031,396.

j. Polystyrenes

Examples include the polystyrylamine polymer described in U.S. Pat. No. 4,315,071 and the halogenated styrene polymer described in U.S. Pat. No. 3,861,918.

k. Terpolymers

Examples include the acrylamide/acrylic acid/vinyl imidazole tertiary copolymers described in Japanese Patent Examined Publication No. 7561/1968 and German Patent Nos. 2,012,095 and 2,012,970.

l. Others

Examples include the vinyl polymer having an azaindene group described in Japanese Patent O.P.I. Publication No. 8604/1984, the polyalkylene oxide derivative described in U.S. Pat. No. 2,976,150, the polyvinylamine imide polymer described in U.S. Pat. No. 4,022,623, the polymers described in U.S. Pat. Nos. 4,294,920 and 4,089,688, the polyvinyl pyridine described in U.S. Pat. No. 2,484,456, the vinyl polymer having an imidazole group described in U.S. Pat. No. 3,520,857, the vinyl polymer having a triazole group described in Japanese Patent Examined Publication No. 658/1985, the polyvinyl-2-methylimidazole and acrylamide/imidazole copolymer described in the Journal of the Society of Photographic Science and Technology of Japan, vol. 29, No. 1, p. 18, dextran and the water-soluble polyalkylene aminotriazoles described in Zeitschrift Wissenschaftliche Photographie, vol. 45, p. 43 (1950).

In the present invention, when a sparingly gelable dispersant is used to as a dispersant for protective colloid in preparing the fine grain emulsion to be supplied, it is preferable to perform washing by coagulation etc. to remove a part or all of the sparingly gelable dispersant contained in the emulsion after completion of crystalline growth of silver halide grains. It is a preferred mode of embodiment of the present invention to remove the other substances, mainly salts, dissolved in the emulsion simultaneously with removal of the sparingly gelable dispersant.

The emulsion of the present invention preferably has a more uniform distribution of silver iodide content among the grains. When the average silver iodide content of each silver halide grain is measured by the XMA method, the relative standard deviation for the measurements is preferably not more than 20%, more preferably not more than 15%, and still more preferably not more than 12%.

Here, the relative standard deviation is defined as obtained by multiplying by 100 the value obtained by dividing the standard deviation of the silver iodide content in at least 100 emulsion grains by the average silver iodide content.

The silver halide grains of the present invention are not subject to limitation with respect to crystal habit.

The silver halide grains of the present invention may be of a regular crystal such as cubic, octahedral, dodecahedral, tetradecahedral or tetraicosahedral crystal, or a twin crystal of tabular or other form, or of amorphous grains such as those in a potato-like form. The silver halide grains may comprise a mixture of these forms.

In the case of a tabular twin crystal, it is preferable that grains wherein the ratio of the diameter of circle converted from projected area and the grain thickness is 1 to 20 account for not less than 60% of the projected area, more preferably 1.2 to 8.0, and still more preferably 1.5 to 5.0.

The silver halide emulsion of the present invention is preferably a monodispersed silver halide emulsion.

In the present invention, a monodispersed silver halide emulsion means a silver halide emulsion wherein the weight of silver halide grains which fall in the grain size range of $\pm 20\%$ of the average grain size $\bar{d}$ accounts for not less than 70% of the total silver halide weight, preferably not less than 80%, and more preferably not less than 90%.

Here, the average grain diameter $\bar{d}$ is defined as the grain diameter di which gives a maximum value for $ni \times di^3$, wherein di denotes the grain diameter and ni denotes the number of grains having a diameter of di (significant up to three digits, rounded off at the last digit).

The grain diameter stated here is the diameter of a circle converted from a grain projection image with the same area.

Grain size can be obtained by measuring the diameter of the grain or the area of projected circle on an electron micrograph taken at $\times$ 10000 to 50000 (the number of subject grains should be not less than 1000 randomly).

A highly monodispersed emulsion preferred for the present invention has a distribution width of not more than 20%, more preferably not more than 15%, defined as follows.

$$\frac{\text{Grain size standard deviation}}{\text{Average grain size}} \times 100 = \text{coefficient of variation or distributuion width (\%)}$$

Here, grain size is measured by the method described above, and average grain size is expressed in arithmetic mean.

$$\text{Average grain size} = \frac{\Sigma dini}{\Sigma ni}$$

The average grain size of the silver halide emulsion of the present invention is preferably 0.1 to 10.0 μm, more preferably 0.2 to 5.0 μm, and still more preferably 0.3 to 3.0 μm.

With respect to the emulsion of the present invention or another emulsion used in combination therewith as necessary to form a light-sensitive material obtained using the emulsion of the invention (hereinafter also referred to as the light-sensitive material of the present invention), a substance other than gelatin which is adsorptive to silver halide grains may be added during its preparation (including preparation of the seed emulsion). Examples of substances which serve well as such adsorbents include compounds used as sensitizing dyes, antifogging agents or stabilizers by those skilled in the art, and heavy metal ions.

Examples of the adsorbent are given in Japanese Patent O.P.I. Publication No. 7040/1987 and other publications.

Of the adsorbents, at least one antifogging agent or stabilizer is preferably added during preparation of the seed emulsion, since it reduces the fogging and improves the storage stability of the emulsion.

Of the antifogging agents and stabilizers, heterocyclic mercapto compounds and/or azaindene compounds are preferred. Examples of more preferable heterocyclic mercapto compounds and azaindene compounds are described in detail in Japanese Patent O.P.I. Publication No. 41848/1988, for instance.

Although the amount of the heterocyclic mercapto compounds and azaindene compounds added is not limitative, it is preferably $1\times10^{-5}$ to $3\times10^{-2}$ mol, more preferably $5\times10^{-5}$ to $3\times10^{-3}$ mol per mol of silver halide. This amount is appropriately selected according to the silver halide grain preparation conditions, the average grain size of silver halide grains and the kind of the compounds.

The finished emulsion, provided with a given set of grain conditions, may be desalted by a known method after formation of silver halide grains. Desalting may be achieved using the coagulating gelatin etc. described in Japanese Patent O.P.I. Publication Nos. 243936/1988 and 185549/1989 or using the noodle washing method using gelled gelatin. Also available is the coagulation method utilizing an inorganic salt comprising a polyvalent anion, such as sodium sulfide, anionic surfactant or anionic polymer such as polystyrene sulfonic acid.

The silver halide emulsion thus desalted is normally dispersed in gelatin to yield an emulsion.

The light-sensitive material of the present invention may incorporate silver halide grains other than the silver halide grains of the invention.

The silver halide grains used in combination with the silver halide grains of the invention may have any grain size distribution, i.e., the emulsion may be an emulsion having a broad grain size distribution (referred to as polydispersed emulsion) or a monodispersed emulsion with a narrow grain size distribution.

The light-sensitive material of the present invention is formed by adding the silver halide grains of the invention to at least one of the silver halide emulsion layers which constitute it, but the same layer may contain silver halide grains other than the silver halide grains of the invention.

In this case, it is preferable that the emulsion containing the silver halide grains of the present invention account for not less than 20% by weight, more preferably not less than 40% by weight.

When the light-sensitive material of the present invention has two or more silver halide emulsion layers, there may be an emulsion layer comprising silver halide grains other than the silver halide grains of the invention.

In this case, it is preferable that the emulsion of the present invention account for not less than 10% by weight, more preferably not less than 20% by weight of the silver halide emulsion used in all light-sensitive layers that constitute the light-sensitive material.

The silver halide grains of the present invention may be spectrally sensitized using the spectral sensitizers described in the following volumes and pages of Research Disclosure (hereinafter referred to as RD) singly or in combination with another sensitizer.

RD No. 17643, pp. 23-24

RD No. 18716, pp. 648-649

RD No. 308119. p. 996, IV, Terms A, B, C, D, H, I, J

The effect of the present invention is enhanced by spectrally sensitizing the silver halide grains of the invention. The effect of the invention is further enhanced when a trimethine and/or monomethine cyanine dye is used singly or in combination with another spectral sensitizer. It is therefore particularly preferable to use a trimethine and/or monomethine cyanine dye singly or in combination with another spectral sensitizer as a spectral sensitizer for the emulsion and color light-sensitive material of the invention.

Also, the silver halide grains other than the silver halide grains of the present invention, used as necessary in the light-sensitive material of the invention, may be optically sensitized in the desired wavelength range. In this case, the method of optical sensitization is not subject to limitation; for example, cyanine dyes, merocyanine dyes and other optical sensitizers, such as zeromethine dyes, monomethine dyes, dimethine dyes and trimethine dye, may be used singly or in combination to optically sensitize the grains. Sensitizing dyes are often used in combination for the purpose of supersensitization. The emulsion may contain a supersensitizing dye which is a dye having no spectral sensitizing activity or which is a substance showing substantially no absorption of visible light along with sensitizing dyes. These methods are described in U.S. Pat. Nos. 2,688,545, 2,912,329, 3,397,060, 3,615,635 and 3,628,964, British Patent Nos. 1,195,302, 1,242,588 and 1,293,862, West German Patent OLS Nos. 2,030,326 and 2,121,780, Japanese Patent Examined Publication No. 14030/1968 and RD No. 176, 17643 (issued December of 1978), p. 23, IV, Term J. These methods can be arbitrarily selected according to the target wavelength range, sensitivity and other aspects, and the purpose and use of the light-sensitive material.

The effect of the present invention can be further enhanced by reduction sensitizing the silver halide grains of the invention.

In the present invention, although there is no limitation with respect to which reducing agent is used for reduction sensitization, thiourea dioxide (U.S. Pat. No. 2,983,609), stannous chloride (U.S. Pat. No 2,487,850) and other reducing agents are preferably used. Examples of other appropriate reducing agents include borane compounds (U.S. Pat. No. 3,361,564), hydrazine derivatives (U.S. Pat. No. 2,419,974), silane compounds (U.S. Pat. No. 2,694,637), polyamines (U.S. Pat. No. 2,518,698), ascorbic acid derivatives and sulfites. Although the amount of these reducing agents added is determined according to the silver halide grain formation conditions, it preferably ranges from $10^{-7}$ to $10^{-3}$ mol per mol of silver halide. These reducing agents can be used in solution in water or an appropriate solvent.

As for the method of adding a reducing agent, it may be added to the reactor in advance of formation of silver halide grains or added to the reactor after being mixed in an aqueous solution of a soluble silver salt and/or a soluble halide. The reducing agent may also be added separately. Separate addition is preferable, since it makes it possible to conduct reduction sensitization at the desired position on the grain structure. In this case, the reducing agent may be added at a time or in several portions, or continuously added for a given time in parallel to grain growth. Another preferred method is such that a fine silver halide grain emulsion mixed with a reducing agent or a reduction sensitized fine grain emulsion is used to simultaneously achieve the formation of silver halide grains and the formation or provision of a reduction sensitizing nucleus to the silver halide grains.

In the present invention, reduction sensitization may be made at any portion of silver halide grains. It is a preferred mode of embodiment of the present invention that a part or all of at least the surface phase and/or the inner phase adjacent thereto of the grain-constituting phases is reduction sensitized.

In the present invention, it is preferable to deactivate the reducing agent added at the desired time point during grain formation by adding an oxidant at the desired time point to suppress or stop the reduction sensitization, whereby the position, number, size and distribution of the reduction sensitization nuclei in the silver halide grains can be controlled.

Examples of usable oxidants include hydrogen peroxide (including aqueous hydrogen peroxide) and its adducts such as $H_2O_2$—$NaBO_2$, $H_2O_2$—$3H_2O$, $2Na_2CO_3$—$3H_2O_2$, $Na_4P_2O_7$—$2H_2O_2$ and $2Na_2SO_4$—$HO_2$—$2H_2O$, and salts of peroxo acid such as $K_2S_2O_8$, $K_2C_2O_6$, $K_4P_2O_8$ and $K_2[Ti(O_2)C_2O_4]$—$3H_2O$, peracetic acid, ozone and $I_2$.

Of these oxidants, hydrogen peroxide or its adduct or precursor is preferred.

Although the amount of oxidant used for the present invention varies depending on the kind of reducing agent, reduction sensitization conditions, timing and conditions of addition of the oxidant and other factors, it is preferably $10^{-2}$ to $10^5$ mol, more preferably $10^{-1}$ to $10^3$ mol per mol of the reducing agent used.

The oxidant may be added at any timing, as long as it is added between formation of silver halide grains and addition of a gold sensitizer (or chemical sensitizer if a gold sensitizer is not used) in the chemical sensitization process.

The emulsion of the present invention is preferably supplemented with a reducing substance after adding an oxidant and before adding a chemical sensitizer. This is to neutralize the excess oxidant to prevent it from adversely affecting the chemical sensitization process.

Any reducing substance can be used for the present invention, as long as it is capable of reducing the oxidant. Examples thereof include sulfinic acids, di- and trihydroxybenzenes, chromanes, hydrazines/hydrazides, p-phenylenediamines, aldehydes, aminophenols, enediols, oximes, reducing sugars, phenidones and sulfites.

The amount of reducing substance added is preferably $10^{-1}$ to $10^2$ mol per mol of the oxidant used.

When silver ripening or high pH ripening is conducted for reduction sensitization, the position, number, size and distribution of the reduction sensitizing nuclei can be controlled by regulating the pAg and pH.

In the present invention, various ordinary chemical sensitization treatments may be performed in addition to the above treatments. Chalcogen sensitizers for chemical sensitization include sulfur sensitizers, selenium sensitizers and tellurium sensitizers, but sulfur sensitizers and selenium sensitizers are preferred for photographic use. Known sulfur sensitizers can be used, including thiosulfates, allyl thiocarbamides, thioureas, allyl isothiocyanates, cystine, p-toluenethiosulfonate and rhodanines. The sulfur sensitizers described in U.S. Pat. Nos. 1,574,944, 2,410,689, 2,278,947, 2,728,668, 3,501,313 and 3,656,955, West German Patent OLS No. 1,422,869, Japanese Patent O.P.I. Publication Nos. 24937/1981 and 45016/1980 and other publications can also be used. The sulfur sensitizer is added in an amount sufficient to effectively increase the sensitivity of emulsion. Although this amount varies over a rather wide range according to various conditions such as pH, temperature and AgX grain size, the amount is preferably about $10^{-7}$ to $10^{-1}$ mol per mol of silver halide.

Examples of usable selenium sensitizers include aliphatic isoselenocyanates such as allyl isoselenocyanates, selenoureas, selenoketones, selenoamides, selenocarboxylic acids and esters thereof, selenophosphates, and selenides such as diethyl selenide and diethyl diselenide. Specific examples thereof are given in U.S. Pat. Nos. 1,574,944, 1,602,592 and 1,623,499.

Although the amount of addition varies over a wide range like the sulfur sensitizers, it is preferably about $10^{-7}$ to $10^{-1}$ mol per mol of silver halide.

In the present invention, various gold compounds can be used as gold sensitizers, whether the oxidation number of gold is + 1 or + 3. Typical examples thereof include chloroauric acids, potassium chloroaurate, auric trichloride, potassium auric thiocyanate, potassium iodoaurate, tetracyanoauric acid, ammonium aurothiocyanate and pyridyl trichloroaurate.

Although the amount of gold sensitizer added varies according to various conditions, it is preferably about $10^{-7}$ to $10^{-1}$ mol per mol of silver halide.

Timing of addition of gold sensitizer may be simultaneous with the addition of a sulfur sensitizer or selenium sensitizer or during or after completion of the sulfur or selenium sensitization process.

The pAg and pH of the emulsion to be subjected to sulfur sensitization or selenium sensitization and gold sensitization for the present invention preferably range from 5.0 to 10.0 and 5.0 to 9.0, respectively.

The chemical sensitization method for the present invention may be used in combination with other sensitization methods using salts of other noble metals such as platinum, palladium, iridium and rhodium or their complex salts.

Examples of compounds which effectively act to eliminate the gold ion from gold gelatinate and promote gold ion adsorption to silver halide grains include complexes of Rh, Pd, Ir, Pt and other metals.

Such complexes include $(NH_4)_2[PtCl_4)]$, $(NH_4)_2[PdCl_4]$, $K_3[IrBr_6]$ and $(NH_4)_3[RhCl_6]_{12}H_2O$, with preference given to ammonium tetrachloropalladate (II) $(NH_4)_2[PdCl_4]$. The amount of addition preferably ranges from 10 to 100 times the amount of gold sensitizer as of stoichiometric ratio (molar ratio).

Although the timing of addition may be at initiation, during or after completion of chemical sensitization, these compounds are added preferably during chemical sensitization, more preferably simultaneously with, or immediately before or after, addition of gold sensitizer.

In chemical sensitization, a compound having a nitrogen-containing heterocyclic ring, particularly an azaindene ring, may also be present.

Although the amount of nitrogen-containing heterocyclic compound added varies over a wide range according to the size and composition of emulsion grains and chemical sensitization conditions and other factors, it is added preferably in an amount such that one to ten molecular layers are formed on the surface of silver halide grains. This amount of addition can be adjusted by controlling the adsorption equilibrium status by changing the pH and/or temperature during sensitization. Also, two or more of the compounds described above may be added to the emulsion so that the total amount thereof falls in the above range.

The compound may be added to the emulsion in solution in an appropriate solvent which does not adversely affect the photographic emulsion, such as water or an aqueous solution of alkali. The timing of addition is preferably before or simultaneous with the addition of a sulfur sensitizer or selenium sensitizer for chemical sensitization. The timing of addition of gold sensitizer may be during or after completion of sulfur or selenium sensitization.

The silver halide grains may also be optically sensitized with a sensitizing dye in the desired wavelength range.

In performing the present invention, various additives may be added to the light-sensitive material. Examples of usable known photographic additives are given in the following RD numbers. The following table shows where the additives are described.

| Item | Page in RD308119 | | RD17643 | RD18716 |
|---|---|---|---|---|
| Antistaining agent | 1002 | VII-Term I | 25 | 650 |
| Dye image stabilizer | 1002 | VII-Term J | 25 | |
| Brightening agent | 998 | V | 24 | |
| Ultraviolet absorbent | 1003 | VIII-Term C, XIII-Term C | 25–26 | |
| Light absorbent | 1003 | VIII | 25–26 | |
| Light scattering agent | 1003 | VIII | | |
| Filter dye | 1003 | VIII | 25–26 | |
| Binder | 1003 | IX | 26 | 651 |
| Antistatic agent | 1006 | XIII | 27 | 650 |
| Hardener | 1004 | X | 26 | 651 |
| Plasticizer | 1006 | XII | 27 | 650 |
| Lubricant | 1006 | XII | 27 | 650 |
| Activator, coating aid | 1005 | XI | 26–27 | 650 |
| Matting agent | 1007 | X, VI | | |
| Developing agent (contained in the light-sensitive material) | 1011 | XX-Term B | | |

Various couplers may be used for the present invention. Examples thereof are given in the above RD numbers. The following table shows where they are described.

| Item | Page in RD308119 | | RD17643 |
|---|---|---|---|
| Yellow coupler | 1001 | VII-Term D | VII-Terms C–G |
| Magenta coupler | 1001 | VII-Term D | VII-Terms C–G |
| Cyan coupler | 1001 | VII-Term D | VII-Terms C–G |
| Colored coupler | 1002 | VII-Term G | VII-Term G |
| DIR coupler | 1001 | VII-Term F | VII-Term F |
| BAR coupler | 1002 | VII-Term F | |
| Other couplers which release a useful residue | 1001 | VII-Term F | |
| Alkali-soluble coupler | 1001 | VII-Term E | |

The additives used for the present invention can be added by dispersion as described in RD308119 XIV and by other methods.

In the present invention, the supports described in RD17643, p. 28, RD18716, pp. 647–648 and RD308119 XIX can be used.

The light-sensitive material of the present invention may be provided with auxiliary layers such as a filter layer and interlayer as described in RD308119, VII-Term K.

The light-sensitive material of the present invention can take various layer configurations such as the ordinary, reverse and unit structures described in RD308119, VII-Term K.

The present invention is preferably applicable to various color light-sensitive materials represented by color negative films for ordinary or movie use, color reversal films for slides or television, color printing paper, color positive films and color reversal printing paper The invention can also be used for other various purposes such as black-and-white photography, X-ray photography, infrared photography, microwave photography, silver dye bleaching, diffusion transfer and reversion.

The light-sensitive material of the present invention can be developed by a known ordinary method, for example, the ordinary methods described in RD17643, pp. 28–29, RD18716, p. 615 and RD308119 XIX.

EXAMPLES

The present invention is hereinafter described in more detail by means of the following examples, but the invention is not limited to these examples.

Example 1

Preparation of octahedral silver iodobromide emulsion EM-1

An octahedral silver iodobromide emulsion was prepared by the double jet method using monodispersed silver iodobromide grains having an average grain size of 0.33 μm and a silver iodide content of 2 mol% as seed crystals.

While vigorously stirring the solution G-1 at a temperature of 75° C., a pAg of 7.8 and a pH of 7.0, the seed emulsion in an amount equivalent to 0.34 mol was added.

Formation of inner high iodide phase or core

Then, the solutions H-1 and S-1 were added at increasing flow rates (the final flow rate was 3.6 times the initial flow rate) at a constant molar ratio of 1 to 1 over a period of 86 minutes.

Formation of outer low iodide phase or shell

Subsequently, the solutions H-2 and S-2 were added at increasing flow rates (the final flow rate was 5.2 times the initial flow rate) at a constant molar ratio of 1 to 1 over a period of 65 minutes while keeping a pAg of 10.1 and a pH of 6.0.

After formation of grains, the mixture was washed by the conventional flocculation method and adjusted to a pH of 5.8 and a pAg of 8.06 at 40° C.

The resulting emulsion was a monodispersed emulsion comprising octahedral silver iodobromide grains having an average grain size of 0.99 μm, a distribution width of 12.4% and a silver iodide content of 8.5 mol%. This emulsion is referred to as EM-1.

Preparation of octahedral silver iodobromide emulsion EM-2

An octahedral silver iodobromide emulsion was prepared in the same manner as with the emulsion EM-1 except that the solutions H-3 and S-3 were used in place of H-2 and S-2 to form the shell.

Formation of surface phase

Subsequently, the solutions H-4 and S-4 were supplied. Preparation of octahedral silver iodobromide emulsion EM-3

An octahedral silver iodobromide emulsion was prepared in the same manner as with the emulsion EM-1.

Formation of surface phase

Subsequently, the solution H-5 was added, followed by conversion reaction to increase the surface phase iodide content.

| | | |
|---|---|---|
| G-1 | | |
| | Ossein gelatin | 100.0 g |
| | (average molecular weight = 100000) | |
| | Compound I | 25.0 ml |
| | 28% aqueous ammonia | 440.0 ml |
| | 56% aqueous solution of acetic acid | 660.0 ml |
| | Water was added to make a total quantity of | 5000.0 ml. |

Compound I: 10% aqueous ethanol solution of sodium salt of polyisopropylene-polyethyleneoxy-disuccinate

| | | |
|---|---|---|
| H-1 | | |
| | Ossein gelatin | 82.4 g |
| | Potassium bromide | 151.6 g |
| | Potassium iodide | 90.6 g |
| | Water was added to make a total quantity of | 1030.5 ml. |
| S-1 | | |
| | Silver nitrate | 309.2 g |
| | Water was added to make a total quantity of | 1030.5 ml. |
| H-2 | | |
| | Ossein gelatin | 302.1 g |
| | Potassium bromide | 770.0 g |
| | Potassium iodide | 33.2 g |
| | Water was added to make a total quantity of | 3776.8 ml. |
| S-2 | | |
| | Silver nitrate | 1133.0 g |
| | Water was added to make a total quantity of | 3776.8 ml. |
| H-3 | | |
| | Ossein gelatin | 278.5 g |

-continued

| | | |
|---|---|---|
| | Potassium bromide | 710.0 g |
| | Potassium iodide | 30.6 g |
| | Water was added to make a total quantity of | 3482.4 ml. |
| S-3 | | |
| | Silver nitrate | 1044.7 g |
| | Water was added to make a total quantity of | 3482.4 ml. |
| H-4 | | |
| | Ossein gelatin | 23.6 g |
| | Potassium bromide | 49.5 g |
| | Potassium iodide | 17.3 g |
| | Water was added to make a total quantity of | 294.4 ml. |
| S-4 | | |
| | Silver nitrate | 88.3 g |
| | Water was added to make a total quantity of | 294.4 ml. |
| H-5 | | |

Aqueous solution containing 0.07 mol of potassium iodide Preparation of fine silver bromide grain emulsion MC-1

To 5000 ml of a 9.6 wt% gelatin solution containing 0.05 mol of potassium bromide were added 2500 ml of an aqueous solution containing 10.6 mol of silver nitrate and 2500 ml of an aqueous solution containing 10.6 mol of potassium bromide at increasing flow rates (the final flow rate was 5 times the initial flow rate) over a period of 28 minutes. During formation of the fine grains, the temperature was kept at 35° C.

Electron micrography at a magnification factor of × 60000 revealed that the obtained fine silver bromide grains had an average grain size of 0.032 μm. Preparation of fine silver iodide grain emulsion MC-2

To 5000 ml of a 9.6 wt% gelatin solution containing 0.05 mol of potassium iodide were added 2500 ml of an aqueous solution containing 10.6 mol of silver nitrate and 2500 ml of an aqueous solution containing 10.6 mol of potassium iodide at increasing flow rates (the final flow rate was 5 times the initial flow rate) over a period of 28 minutes. During formation of the fine grains, the temperature was kept at 35° C.

Electron micrography at a magnification factor of × 60000 revealed that the obtained fine silver iodide grains had an average grain size of 0.027 μm.

Preparation of fine silver iodobromide grain emulsion MC-3

To 5000 ml of a 9.6 wt% gelatin solution containing 0.05 mol of potassium bromide were added 2500 ml of an aqueous solution containing 10.6 mol of silver nitrate, 2500 ml of an aqueous solution containing 8.48 mol of potassium bromide and 2500 m; of an aqueous solution containing 2.12 mol of potassium iodide at increasing flow rates (the final flow rate was 5 times the initial flow rate) over a period of 28 minutes. During formation of the fine grains, the temperature was kept at 35° C.

Electron micrography at a magnification factor of × 60000 revealed that the obtained fine silver iodobromide grains had an average grain size of 0.030 μm.

Preparation of octahedral silver iodobromide emulsion EM-4

An octahedral silver iodobromide emulsion was prepared by supplying fine silver halide grains, using monodispersed silver iodobromide grains having an average grain size of 0.33 μm and a silver iodide content of 2 mol% as seed crystals.

While vigorously stirring the solution G-1 at a temperature of 75° C., a pAg of 7.8 and a pH of 7.0, 144.4 ml (equivalent to 0.34 mol) of the seed emulsion was added. Formation of inner high iodide phase or core Then, the fine silver bromide grain emulsion MC-1 and the fine silver iodide grain emulsion MC-2 were added at increasing flow rates (the final flow rate was 3.6 times the initial flow rate) at a constant molar ratio of 70 to 30 over a period of 86 minutes. The amount of fine grains consumed during this addition was equivalent to 1.82 mol in total for MC-1 and MC-2.

Formation of outer low iodide phase or shell

Subsequently, the fine silver bromide grain emulsion MC-1 and the fine silver iodide grain emulsion MC-2 were added at increasing flow rates (the final flow rate was 5.2 times the initial flow rate) at a constant molar ratio of 97 to 3 over a period of 65 minutes while keeping a pAg of 10.1 and a pH of 6.0. The amount of fine grains consumed during this addition was equivalent to 6.67 mol in total for MC-1 and MC-2.

After formation of grains, the mixture was washed by the conventional flocculation method and adjusted to a pH of 5.8 and a pAg of 8.06 at 40° C.

The resulting emulsion was a monodispersed emulsion comprising octahedral silver iodobromide grains having an average grain size of 0.99 μm, a distribution width of 10.7% and a silver iodide content of 8.5 mol%. This emulsion is referred to as EM-4.

Preparation of octahedral silver iodobromide emulsion EM-5

An octahedral silver iodobromide emulsion was prepared in the same manner as with the emulsion EM-4 except that the amount of fine grains supplied to form the shell was equivalent to 6.15 mol in total for MC-1 and MC-2.

Formation of surface phase

Subsequently, the solutions H-4 and S-4 were supplied like EM-2.

Preparation of octahedral silver iodobromide emulsion EM-6

An octahedral silver iodobromide emulsion was prepared in the same manner as with the emulsion EM-4.

Formation of surface phase

Subsequently, the solution H-6 was added in the same manner as with EM-3, followed by conversion reaction to increase the surface phase iodide content.

Preparation of octahedral silver iodobromide emulsion EM-7

An octahedral silver iodobromide emulsion was prepared in the same manner as with the emulsion EM-4 except that the amount of fine grains supplied to form the shell was equivalent to 6.15 mol in total for MC-1 and MC-2. Formation of surface phase Subsequently, the fine silver iodobromide grain emulsion MC-3 was supplied in an amount equivalent to 0.52 mol.

Preparation of octahedral silver iodobromide emulsion EM-8

An octahedral silver iodobromide emulsion was prepared in the same manner as with the emulsion EM-4 except that the amount of fine grains supplied to form the shell was equivalent to 6.60 mol in total for MC-1 and MC-2. Formation of surface phase Subsequently, the fine silver iodide grain emulsion MC-2 was supplied in an amount equivalent to 0.07 mol.

The emulsions EM-1 through EM-8 thus obtained are summarized in Table 1.

TABLE 1

| Emulsion | Surface silver iodide content (mol %) Core | Shell | Surface phase | Average silver iodide content (mol %) |
|---|---|---|---|---|
| EM-1 (comparative) | 30 (28.5) | 3 (5.5) | — | 8.5 |
| EM-2 (comparative) | 30 (28.5) | 3 (5.5) | 20 (15.3) | 9.5 |
| EM-3 (comparative) | 30 (28.5) | 3 (5.5) | — (11.4) | 9.3 |
| EM-4 (comparative) | 30 (29.2) | 3 (3.6) | — | 8.5 |
| EM-5 (comparative) | 30 (29.2) | 3 (3.6) | 20 (16.7) | 9.5 |
| EM-6 (comparative) | 30 (29.2) | 3 (3.6) | — (10.6) | 9.3 |
| EM-7 (inventive) | 30 (29.2) | 3 (3.6) | 20 (18.4) | 9.5 |
| EM-8 (inventive) | 30 (29.2) | 3 (3.6) | — (13.1) | 9.3 |

Note:
Figures are design values for the silver iodide content of each phase. Figures in parentheses are values for the silver iodide content of each portion in the grain measured by the XPS method on the sample taken after formation of each phase.

Preparation of silver halide photographic light-sensitive material samples

The emulsions EM-1 through EM-8 were each subjected to optimal gold/sulfur sensitization and spectral sensitization. Using these emulsions, the following layers with the compositions shown below were sequentially formed on a triacetyl cellulose film support in the order from the support side to yield multiple layered color photographic light-sensitive material samples.

In all examples given below, the amount of addition in silver halide photographic light-sensitive material is expressed in gram per $m^2$, unless otherwise stated. The figures for silver halide and colloidal silver have been converted to the amounts of silver. Figures for the amount of sensitizing dyes are shown in mol per mol of silver in the same layer.

The configuration of the multiple layered color photographic light-sensitive material sample No. 1 was as follows.

| Sample No. 1 (comparative) | |
|---|---|
| Layer 1: Anti-halation layer HC | |
| Black colloidal silver | 0.2 |
| UV absorbent UV-1 | 0.23 |
| High boiling solvent Oil-1 | 0.18 |
| Gelatin | 1.4 |
| Layer 2: First interlayer IL-1 | |
| Gelatin | 1.3 |
| Layer 3: Low speed red-sensitive emulsion layer RL | |
| Silver iodobromide emulsion EM-L | 1.0 |
| Sensitizing dye SD-1 | $1.8 \times 10^{-5}$ |
| Sensitizing dye SD-2 | $2.8 \times 10^{-4}$ |
| Sensitizing dye SD-3 | $3.0 \times 10^{-4}$ |
| Cyan coupler C-1 | 0.70 |
| Colored cyan coupler CC-1 | 0.066 |
| DIR compound D-1 | 0.03 |
| DIR compound D-3 | 0.01 |
| High boiling solvent Oil-1 | 0.64 |
| Gelatin | 1.2 |
| Layer 4: Moderate speed red-sensitive emulsion layer RM | |
| Silver iodobromide emulsion EM-M | 0.8 |
| Sensitizing dye SD-1 | $2.1 \times 10^{-5}$ |
| Sensitizing dye SD-2 | $1.9 \times 10^{-4}$ |
| Sensitizing dye SD-3 | $1.9 \times 10^{-4}$ |
| Cyan coupler C-1 | 0.28 |
| Colored cyan coupler CC-1 | 0.027 |
| DIR compound D-1 | 0.01 |
| High boiling solvent Oil-1 | 0.26 |
| Gelatin | 0.6 |

-continued

| Sample No. 1 (comparative) | |
|---|---|
| Layer 5: High speed red-sensitive emulsion layer RH | |
| Silver iodobromide emulsion EM-1 | 1.70 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler C-1 | 0.05 |
| Cyan coupler C-2 | 0.10 |
| Colored cyan coupler CC-1 | 0.02 |
| DIR compound D-1 | 0.025 |
| High boiling solvent Oil-1 | 0.17 |
| Gelatin | 1.2 |
| Layer 6: Second interlayer IL-2 | |
| Gelatin | 0.8 |
| Layer 7: Low speed green-sensitive emulsion layer GL | |
| Silver iodobromide emulsion EM-L | 1.1 |
| Sensitizing dye SD-4 | $6.8 \times 10^{-5}$ |
| Sensitizing dye SD-5 | $6.2 \times 10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: Moderate speed green-sensitive emulsion layer GM | |
| Silver iodobromide emulsion EM-M | 0.7 |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |
| Magenta coupler M-1 | 0.07 |
| Magenta coupler M-2 | 0.03 |
| Colored magenta coupler CM-1 | 0.04 |
| DIR compound D-2 | 0.018 |
| High boiling solvent Oil-2 | 0.30 |
| Gelatin | 0.8 |
| Layer 9: High speed green-sensitive emulsion layer GH | |
| Silver iodobromide emulsion EM-1 | 1.7 |
| Sensitizing dye SD-4 | $2.1 \times 10^{-5}$ |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-5}$ |
| Magenta coupler M-1 | 0.09 |
| Magenta coupler M-3 | 0.04 |
| Colored magenta coupler CM-1 | 0.04 |
| High boiling solvent Oil-2 | 0.31 |
| Gelatin | 1.2 |
| Layer 10: Yellow filter layer YC | |
| Yellow colloidal silver | 0.05 |
| Antistaining agent SC-1 | 0.1 |
| High boiling solvent Oil-2 | 0.13 |
| Gelatin | 0.7 |
| Formalin scavenger HS-1 | 0.09 |
| Formalin scavenger HS-2 | 0.07 |
| Layer 11: Low speed blue-sensitive emulsion layer BL | |
| Silver iodobromide emulsion EM-L | 0.5 |
| Silver iodobromide emulsion EM-M | 0.5 |
| Sensitizing dye SD-9 | $5.2 \times 10^{-4}$ |

-continued

| Sample No. 1 (comparative) | |
|---|---|
| Sensitizing dye SD-10 | $1.9 \times 10^{-5}$ |
| Yellow coupler Y-1 | 0.65 |
| Yellow coupler Y-2 | 0.24 |
| DIR compound D-1 | 0.03 |
| High boiling solvent Oil-2 | 0.18 |
| Gelatin | 1.3 |
| Formalin scavenger HS-1 | 0.08 |
| Layer 12: High speed blue-sensitive emulsion layer BH | |
| Silver iodobromide emulsion EM-1 | 1.0 |
| Sensitizing dye SD-9 | $1.8 \times 10^{-4}$ |
| Sensitizing dye SD-10 | $7.9 \times 10^{-5}$ |
| Yellow coupler Y-1 | 0.15 |
| Yellow coupler Y-2 | 0.05 |
| High boiling solvent Oil-2 | 0.074 |
| Gelatin | 1.3 |
| Formalin scavenger HS-1 | 0.05 |
| Formalin scavenger HS-2 | 0.12 |
| Layer 13: First protective layer Pro-1 | |
| Fine silver iodobromide grain emulsion having an average grain size of 0.08 μm and an AgI content of 1 mol % | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer Pro-2 | |
| Alkali-soluble matting agent having an average grain size of 2 μm | 0.13 |
| Polymethyl methacrylate having an average grain size of 3 μm | 0.02 |
| Lubricant WAX-1 | 0.04 |
| Gelatin | 0.6 |

In addition to these compositions, a coating aid Su-1, a dispersing agent Su-2, a viscosity controlling agent, hardeners H-1 and H-2, a stabilizer ST-1 and antifogging agents AF-1 and AF-2 having an average molecular weight of 10000 or 1100000, respectively, were added to appropriate layers.

The emulsions EM-L and EM-M used to prepare the sample had the following properties.

Each emulsion was subjected to optimum gold/sulfur sensitization.

| Emulsion | Average grain size (μm) | Average silver iodide content (mol %) | Crystal habit |
|---|---|---|---|
| EM-L | 0.47 | 8.0 | Octahedral to tetradecahedral |
| EM-M | 0.82 | 8.0 | Octahedral |

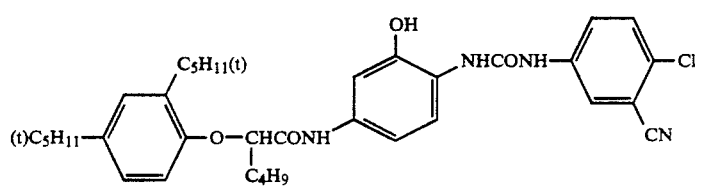

C-1

-continued
C-2
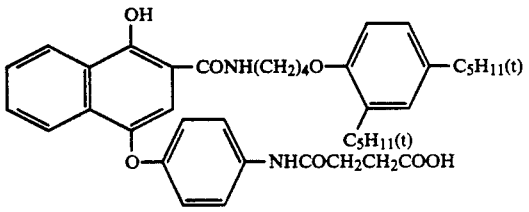
M-1
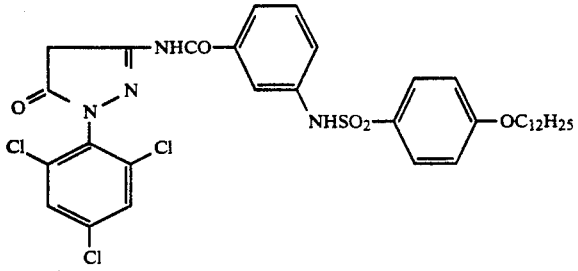
M-2
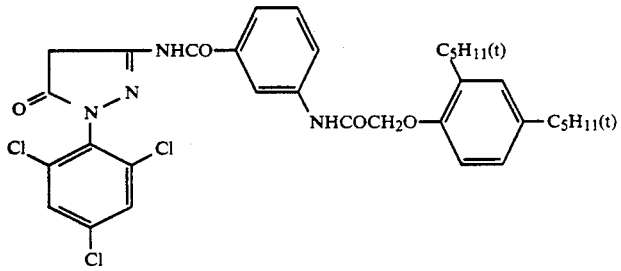
M-3
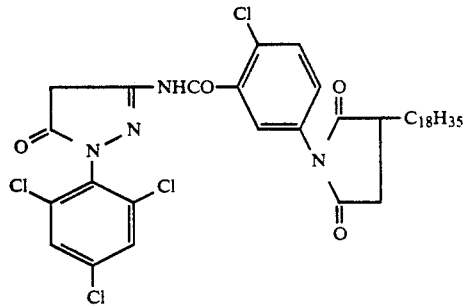
Y-1
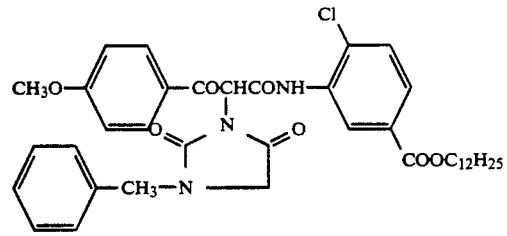
Y-2
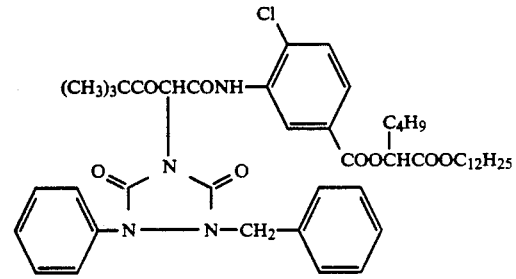

-continued
CC-1
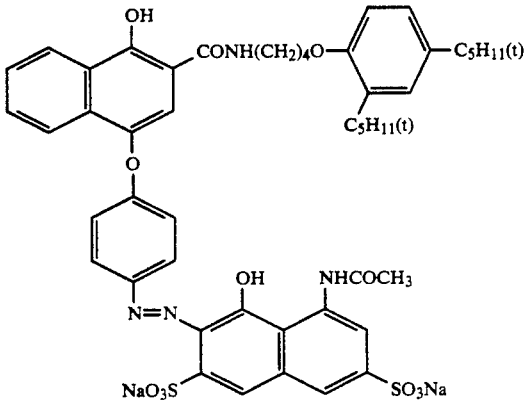
CM-1
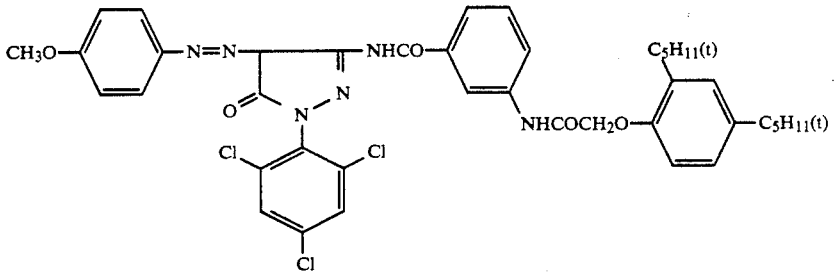
D-1
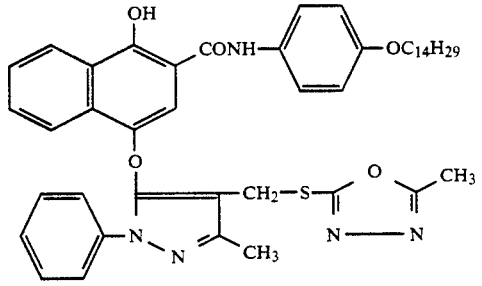
D-2
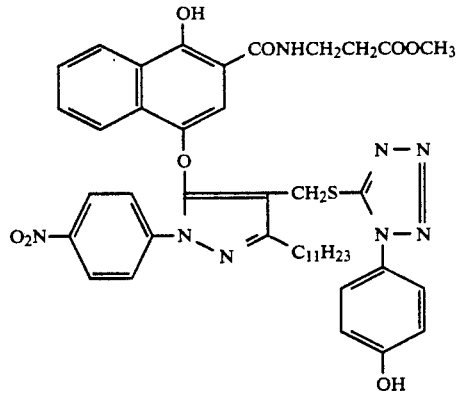

-continued
D-3
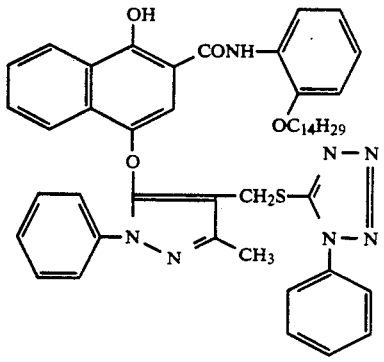
Oil-1
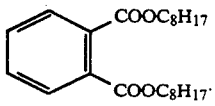
Oil-2
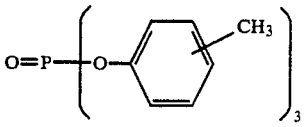
Oil-3
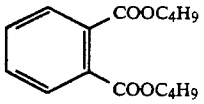
SC-1
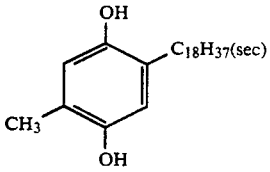
UV-1
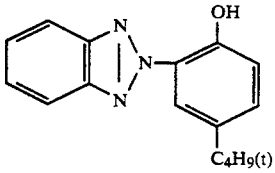
UV-2
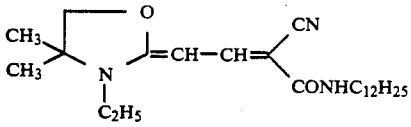
WAX-1
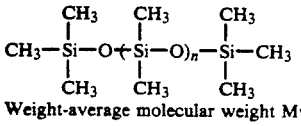
Weight-average molecular weight Mw = 3000
Su-1
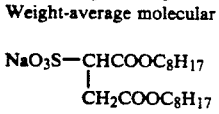
Su-2
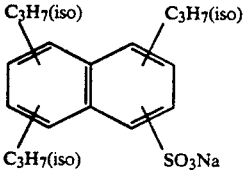

-continued
HS-1
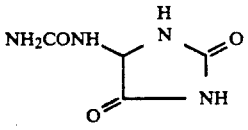
HS-2
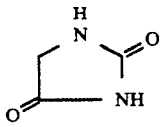
SD-1
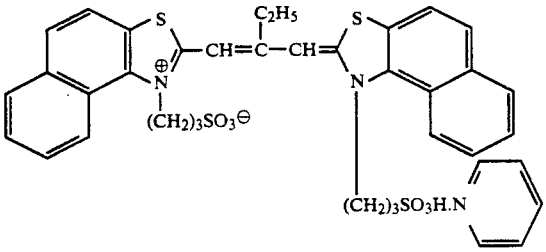
SD-2
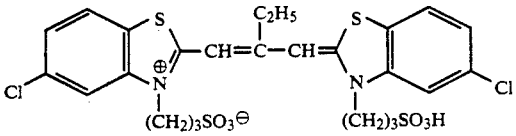
SD-3
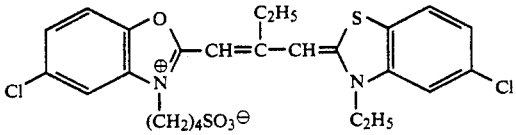
SD-4
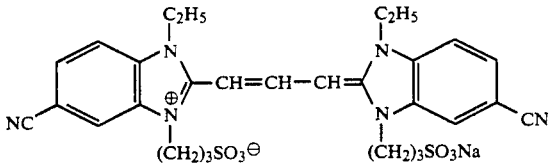
SD-5
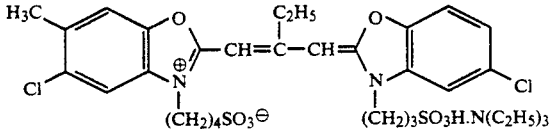
SD-6
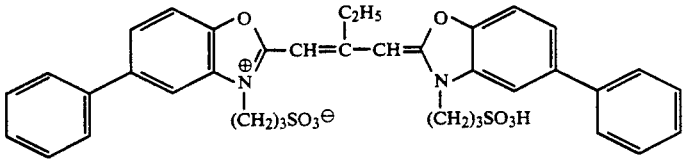
SD-7
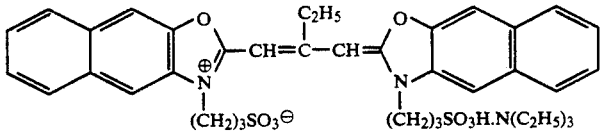
SD-8
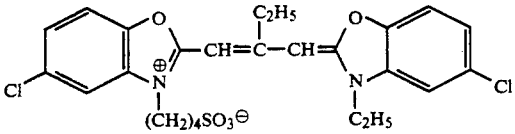

-continued

SD-9

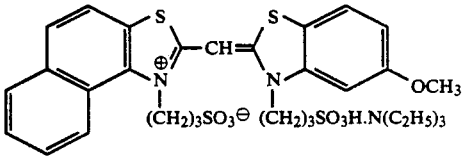

SD-10

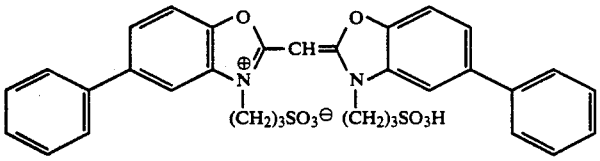

H-1

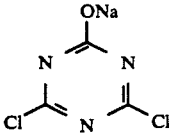

H-2

$(CH_2{=}CHSO_2CH_2)_2O$

ST-1

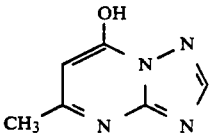

AF-1

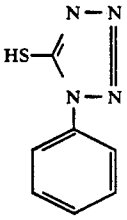

AF-2

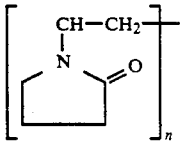

n: Degree of polymerization

Next, sample Nos. 2 through 8 were prepared in the same manner as with sample No. 1 except that the silver iodobromide emulsion EM-1 for layers 5, 9 and 12 was replaced with the emulsions EM-2 through EM-8 as shown in Table 2.

The samples thus prepared were each subjected to white light exposure through an optical wedge and then processed as follows.

| | | |
|---|---|---|
| 1. Color development | 3 minutes 15 seconds | 38.0 ± 0.1° C. |
| 2. Bleaching | 6 minutes 30 seconds | 38.0 ± 3.0° C. |
| 3. Washing | 3 minutes 15 seconds | 24 to 41° C. |
| 4. Fixation | 6 minutes 30 seconds | 38.0 ± 3.0° C. |
| 5. Washing | 3 minutes 15 seconds | 24 to 41° C. |
| 6. Stabilization | 3 minutes 15 seconds | 38.0 ± 3.0° C. |
| 7. Drying | Under 50° C. | |

The processing solutions used in the respective processes had the following compositions.

| Color developer | |
|---|---|
| 4-amino-3-methyl-N-ethyl-N-(β-hydroxylethyl) aniline sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |

Water was added to make a total quantity of 1l, and the pH was adjusted to 10.1.

| Bleach | |
|---|---|
| Iron (III) ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |

Water was added to make a total quantity of 1l, and aqueous ammonia was added to obtain a pH of 6.0.

| Fixer | |
|---|---|
| Ammonium sulfate | 175.0 g |
| Anhydrous sodium sulfite | 8.5 g |
| Sodium metasulfite | 2.3 g |

Water was added to make a total quantity of 1l, and acetic acid was added to obtain a pH of 6.0.

| Stabilizer | |
|---|---|
| Formalin (37% aqueous solution) | 1.5 ml |
| Konidax (produced by Konica Corporation) | 7.5 ml |
| Water was added to make a total quantity of 1 l. | |

The obtained samples were each subjected to determination of relative fogging and relative sensitivity using red light (R), green light (G) and blue light (B) immediately after preparation. The results are shown in Table 2

Relative fogging, or the relative value for minimum density ($D_{min}$), is expressed in percent ratio to each value for $D_{min}$ obtained in the determinations of R, G and B for sample No. 4.

Relative sensitivity, the relative value for the reciprocal of the exposure amount which gives a density of $D_{min}+0.15$, is expressed in percent ratio to the sensitivities obtained with respect to R, G and B for sample No. 4.

After being stored under hot humid conditions of a temperature of 50° C. and a relative humidity of 80% for 5 days, each sample was subjected to white light exposure through an optical wedge in the same manner as above and processed, after which the relative sensitivities R, G and B were determined (expressed in percent ratio to the sensitivities of sample No. 4 determined immediately after preparation). The results are shown in Table 2.

Emulsions (inventive) were prepared in the same manner as with EM-7 and EM-8 except that the surface phase was formed after desalting and washing or before, during or after chemical sensitization, and evaluated in the same manner as above. Good results were obtained as with sample Nos. 7 and 8.

mol for reduction sensitization when 92% of the solutions H-2 and S-2 had been added during formation of the shell. Preparation of octahedral silver iodobromide emulsion EM-10

An octahedral silver iodobromide emulsion was prepared in the same manner as with the emulsion EM-2 of Example 1 except that thiourea dioxide as a reducing agent was added in an amount equivalent to $5\times10^{-5}$ mol before formation of the surface phase.

Preparation of octahedral silver iodobromide emulsion EM-11

An octahedral silver iodobromide emulsion was prepared in the same manner as with the emulsion EM-10 except that aqueous hydrogen peroxide was added in an amount equivalent to $1\times10^{-4}$ mol and the emulsion was subjected to oxidation with stirring at 50° C for 30 minutes after forming the grains. Further, sodium sulfite was added in an amount equivalent to $1'10^{-4}$ mol to neutralize the excess hydrogen peroxide. Then, the emulsion was subjected to washing and adjustments of pH and pAg in the same manner as with the emulsion EM-1.

Preparation of octahedral silver iodobromide emulsion EM-12

An octahedral silver iodobromide emulsion was prepared in the same manner as with the emulsion EM-4 of Example 1 except that the amount of fine grain emulsions supplied to form the shell phase was equivalent to 6.15 mol in total for MC-1 and MC-2. At this time point, thiourea dioxide as a reducing agent was added in an amount equivalent to $5\times 10^{-5}$ mol for reduction sensitization.

Formation of surface phase

Subsequently, the fine silver bromide grain emulsion MC-1 and the fine silver iodide grain emulsion MC-2 were added at a molar ratio of 80 to 20 in the same manner as in the formation of the shell phase. The amount of fine grains consumed during this addition was equivalent to 0.52 mol in total for MC-1 and MC-2.

Then, the emulsion was subjected to washing and adjustments of pH and pAg in the same manner as with the emulsion EM-1.

The resulting emulsion was a monodispersed emulsion comprising octahedral silver iodobromide grains having an average grain size of 0.99 μm, a distribution width of 10.7% and a silver iodide content of 8.5 mol%. This emulsion is referred to as EM-12.

TABLE 2

| | | Red-sensitive layer | | | Green-sensitive layer | | | Blue-sensitive layer | | |
|---|---|---|---|---|---|---|---|---|---|---|
| | | Sensitivity | | | Sensitivity | | | Sensitivity | | |
| Sample number | Emulsion | Fresh samples | Aging samples | Fog | Fresh samples | Aging samples | Fog | Fresh samples | Aging samples | Fog |
| Sample No. 1 (comparative) | EM-1 | 86 | 55 | 128 | 84 | 51 | 131 | 79 | 59 | 124 |
| Sample No. 2 (comparative) | EM-2 | 80 | 73 | 125 | 78 | 67 | 120 | 72 | 66 | 108 |
| Sample No. 3 (comparative) | EM-3 | 85 | 59 | 128 | 82 | 59 | 128 | 78 | 62 | 117 |
| Sample No. 4 (comparative) | EM-4 | 100 | 81 | 100 | 100 | 77 | 100 | 100 | 82 | 100 |
| Sample No. 5 (comparative) | EM-5 | 95 | 88 | 96 | 97 | 89 | 95 | 93 | 89 | 94 |
| Sample No. 6 (comparative) | EM-6 | 101 | 83 | 99 | 103 | 81 | 100 | 98 | 86 | 98 |
| Sample No. 7 (inventive) | EM-7 | 157 | 155 | 80 | 163 | 162 | 81 | 145 | 142 | 77 |
| Sample No. 8 (inventive) | EM-8 | 166 | 161 | 84 | 176 | 172 | 86 | 154 | 151 | 83 |

Example 2

Preparation of octahedral silver iodobromide emulsion EM-9

An octahedral silver iodobromide emulsion was prepared in the same manner as with the emulsion EM-1 of Example 1 except that thiourea dioxide as a reducing agent was added in an amount equivalent to $5\times10^{-5}$ Preparation of octahedral silver iodobromide emulsion EM-13

An octahedral silver iodobromide emulsion was prepared in the same manner as with the emulsion EM-12 except that the fine silver iodobromide grain emulsion MC-3 was used to form the surface phase. Also, the reducing agent was added to MC-3 in advance.

Preparation of octahedral silver iodobromide emulsion EM-14

An octahedral silver iodobromide emulsion was prepared in the same manner as with the emulsion EM-12 except that the amount of fine grains supplied to form the shell was equivalent to 6.60 mol in total for MC-1 and MC-2. Also, the reducing agent was added when fine grains had been added in an amount equivalent to 6.15 mol as with EM-12.

Formation of surface phase

Subsequently, the fine silver iodide grain emulsion MC-2 was supplied in an amount equivalent to 0.07 mol. Then, the emulsion was subjected to washing and adjustments of pH and pAg.

Preparation of octahedral silver iodobromide emulsions EM-9, EM-10 and EM-11 (inventive)

Octahedral silver iodobromide grains were formed in the same manner as with the emulsions EM-12, EM-13 and EM-14, after which they were subjected to oxidation and neutralization in the same manner as with the emulsion EM-11.

Then, the emulsions were subjected to washing and adjustments of pH and pAg in the same manner as above. The emulsions thus obtained are referred to as EM-15, EM-16 and EM-17.

The emulsions thus obtained are summarized in Table 3.

TABLE 3

| Emulsion | Surface silver iodide content (mol %) Core | Shell | Surface phase | Average silver iodide content (mol %) | Reduction sensitization | Oxidation |
|---|---|---|---|---|---|---|
| EM-9 | 30 (29.7) | 3 (5.5) | — | 9.5 | Yes | No |
| EM-10 | 30 (29.7) | 3 (5.8) | 20 (15.3) | 9.5 | Yes | No |
| EM-11 | 30 (29.7) | 3 (5.8) | 20 (15.3) | 9.5 | Yes | Yes |
| EM-12 | 30 (29.3) | 3 (3.7) | 20 (18.1) | 9.5 | Yes | No |
| EM-13 | 30 (29.3) | 3 (3.7) | 20 (18.4) | 9.5 | Yes | No |
| EM-14 | 30 (29.3) | 3 (3.7) | — (13.1) | 9.3 | Yes | No |
| EM-15 | 30 (29.3) | 3 (3.7) | 20 (18.1) | 9.5 | Yes | Yes |
| EM-16 | 30 (29.3) | 3 (3.7) | 20 (18.4) | 9.5 | Yes | Yes |
| EM-17 | 30 (29.3) | 3 (3.7) | — (13.1) | 9.3 | Yes | Yes |

Figures for silver iodide content are design values for the respective phases Figures in parentheses are values for the silver iodide content of each portion in the grain determined by the XPS method on the sample taken after formation of each phase Preparation of silver halide photographic light-sensitive material samples The emulsions EM-9 through EM-17 and the emulsions EM-1 and EM-3 of Example 1 were each subjected to gold/sulfur sensitization and spectral sensitization optimally for exposure for $1\times10^{-2}$ second. Using these emulsions, layers were sequentially formed on a triacetyl cellulose film support in the order from the support side in the same manner as in Example 1 to yield multiple layered color photographic light-sensitive material samples The samples thus prepared were each subjected to white light exposure (color temperature=5400° K.) through an optical wedge for 1 second, $1\times10^{-2}$ second or $1\times10^{-4}$ second, after which they were processed in the same manner as in Example 1.

Each resulting sample was subjected to sensitometric determination using red light (R), green light (G) and blue light (B) immediately after sample preparation. The results are shown in Tables 4, 5 and 6.

Relative fogging, or the relative value for minimum density ($D_{min}$), is expressed in percent ratio to the value for $D_{min}$ obtained with the respect to R, G and B for sample No. 1.

Relative sensitivity, or the relative value for the reciprocal of the exposure amount which gives a density of $D_{min}+0.15$, is expressed in percent ratio to the sensitivities obtained with respect to R, G and B for sample No. 1 as subjected to exposure for $1\times10^{-2}$ second.

TABLE 4

Measurements of red-sensitive layer

| Sample | Exposure time (second) 1 Sensitivity | $1\times10^{-2}$ Sensitivity | $1\times10^{-2}$ Fog | $1\times10^{-4}$ Sensitivity |
|---|---|---|---|---|
| Sample No. 9 (EM-1) | 51 | 100 | 100 | 56 |
| Sample No. 10 (EM-9) | 107 | 213 | 128 | 135 |
| Sample No. 11 (EM-3) | 63 | 121 | 96 | 66 |
| Sample No. 12 (EM-10) | 182 | 223 | 122 | 187 |
| Sample No. 13 (EM-11) | 179 | 216 | 102 | 184 |
| Sample No. 14 (EM-12) | 223 | 262 | 117 | 231 |
| Sample No. 15 (EM-13) | 229 | 270 | 116 | 242 |
| Sample No. 16 (EM-14) | 253 | 281 | 109 | 258 |
| Sample No. 17 (EM-15) | 219 | 255 | 97 | 224 |
| Sample No. 18 (EM-16) | 225 | 262 | 97 | 231 |
| Sample No. 19 (EM-17) | 248 | 277 | 93 | 251 |

TABLE 5

Measurements of green-sensitive layer

| Sample | Exposure time (second) 1 Sensitivity | $1\times10^{-2}$ Sensitivity | $1\times10^{-2}$ Fog | $1\times10^{-4}$ Sensitivity |
|---|---|---|---|---|
| Sample No. 9 (EM-1) | 56 | 100 | 100 | 59 |
| Sample No. 10 (EM-9) | 117 | 229 | 133 | 129 |
| Sample No. 11 (EM-3) | 66 | 124 | 93 | 69 |
| Sample No. 12 (EM-10) | 204 | 245 | 125 | 208 |
| Sample No. 13 (EM-11) | 198 | 241 | 107 | 201 |
| Sample No. 14 (EM-12) | 234 | 269 | 116 | 241 |
| Sample No. 15 (EM-13) | 239 | 273 | 118 | 247 |
| Sample No. 16 (EM-14) | 261 | 288 | 104 | 266 |
| Sample No. 17 (EM-15) | 229 | 261 | 98 | 234 |
| Sample No. 18 (EM-16) | 238 | 271 | 101 | 242 |
| Sample No. 19 (EM-17) | 258 | 285 | 90 | 263 |

TABLE 6

Measurements of blue-sensitive layer

| Sample | Exposure time (second) 1 Sensitivity | $1\times10^{-2}$ Sensitivity | $1\times10^{-2}$ Fog | $1\times10^{-4}$ Sensitivity |
|---|---|---|---|---|
| Sample No. 9 (EM-1) | 48 | 100 | 100 | 54 |
| Sample No. 10 (EM-9) | 93 | 197 | 133 | 107 |
| Sample No. 11 (EM-3) | 56 | 117 | 95 | 60 |
| Sample No. 12 (EM-10) | 170 | 214 | 130 | 178 |
| Sample No. 13 (EM-11) | 166 | 209 | 107 | 174 |

TABLE 6-continued

| Sample | Measurements of blue-sensitive layer: Exposure time (second) 1 Sensitivity | $1 \times 10^{-2}$ Sensitivity | $1 \times 10^{-2}$ Fog | $1 \times 10^{-4}$ Sensitivity |
|---|---|---|---|---|
| Sample No. 14 (EM-12) | 193 | 226 | 121 | 200 |
| Sample No. 15 (EM-13) | 201 | 239 | 124 | 212 |
| Sample No. 16 (EM-14) | 231 | 255 | 111 | 237 |
| Sample No. 17 (EM-15) | 184 | 217 | 104 | 198 |
| Sample No. 18 (EM-16) | 188 | 228 | 103 | 201 |
| Sample No. 19 (EM-17) | 226 | 251 | 97 | 234 |

As is evident from Tables 4 through 6, the silver halide emulsions subjected to reduction sensitization and the light-sensitive materials incorporating them showed very little change in the sensitivity or tone upon change in exposure intensity, thus having a significantly improved reciprocity law failure property both for high and low intensities.

Particularly, the emulsions subjected to oxidation after reduction sensitization showed reduced fog, demonstrating the effectiveness of the oxidation in the present invention.

Also, the emulsions of the present invention wherein silver halide grains were formed by the fine grain supply method had a significantly improved reciprocity law failure property and high sensitivity and reduced fogging, i.e., the objects of the invention were fully accomplished.

Also, with respect to the emulsions (inventive) prepared in the same manner as with EM-13, EM-14, EM-16 and EM-17 except that formation of the surface phase was followed by treatment (including reduction sensitization, oxidation and neutralization) before chemical sensitization, good results were obtained as with EM-13, EM-14, EM-16 and Em-17.

Example 3

Preparation of hexagonally tabular silver iodobromide emulsion EM-A

A hexagonally tabular silver iodobromide emulsion was prepared via crystal growth by continuously supplying fine grains from a mixing vessel for fine grain preparation placed near the reactor.

While vigorously stirring the solution G-10 in the reactor at a temperature of 75° C, a pAg of 8.4 and a pH of 6.5, a seed emulsion comprising tabular silver iodobromide grains was added in an amount equivalent of 0.34 mol.

Formation of inner high iodide phase or core

The solutions H-Al, S-Al and G-Al were continuously added to the mixing vessel under increased pressure by the triple jet method at increased flow rates. The resulting fine grain emulsion was continuously supplied to the reactor. The mixing vessel was kept at an impeller blade rotation rate of 4000 rpm and a temperature of 15° C during this process.

Formation of outer low iodide phase or shell

Subsequently, the solutions H-A2, S-A2 and G-A2 were added to the mixing vessel in the same manner as above. The resulting fine grain emulsion was continuously supplied to the reactor. The mixing vessel was kept at an impeller blade rotation rate of 3500 rpm during this process. Formation of surface phase Further, the solutions H-A3, S-A3 and G-A3 were added to the mixing vessel. The resulting fine grain emulsion was continuously supplied to the reactor.

Electron micrography at a magnification factor of × 60000 revealed that the fine grains formed in the mixing vessel had an average grain size of about 0.014 μm.

Grain formation was followed by low molecular gelatin removal and desalting, after which the grains were dispersed in gelatin (average molecular weight = 100000) and adjusted to a pH of 5.8 and a pAg of 8.06 at 40° C.

The emulsion thus obtained was a monodispersed emulsion comprising hexagonally tabular silver iodobromide grains having an average grain size of 1.37 μm, an aspect ratio of 4, a distribution width of 13.2% and a silver iodide content of 9.3 mol%. This emulsion is referred to as EM-A.

Preparation of hexagonally tabular silver iodobromide emulsions EM-B through EM-I Emulsions EM-B through EM-I were prepared in the same manner as with the emulsion EM-A except that the compositions and amounts of aqueous solutions of halide, silver nitrate and gelatin added to the mixing vessel were different from those of EM-A.

The emulsions EM-A through EM-I thus obtained are summarized in Table 7.

| | |
|---|---|
| G-10 | |
| Ossein gelatin (average molecular weight = 100000) | 120.0 g |
| Compound I | 25.0 ml |
| 28% aqueous ammonia | 440.0 ml |
| 56% aqueous solution of acetic acid | 660.0 ml |
| Water was added to make a total quantity of | 4000.0 ml. |
| H-A1 | |
| Potassium bromide | 178.5 g |
| Potassium iodide | 83.0 g |
| Water was added to make a total quantity of | 800.0 ml. |
| S-A1 | |
| Silver nitrate | 339.7 g |
| Water was added to make a total quantity of | 800.0 ml. |
| G-A1 | |
| Low molecular gelatin (average molecular weight = 10000) | 150.0 g |
| Water was added to make a total quantity of | 1400.0 ml. |
| H-A2 | |
| Potassium bromide | 678.4 g |
| Potassium iodide | 49.8 g |
| Water was added to make a total quantity of 2400.0 | ml. |
| S-A2 | |
| Silver nitrate | 1019.2 g |
| Water was added to make a total quantity of | 2400.0 ml. |
| G-A2 | |
| Low molecular gelatin | 450.0 g |
| Water was added to make a total quantity of | 4200.0 ml. |
| H-A3 | |
| Potassium bromide | 56.6 g |
| Potassium iodide | 2.4 g |
| Water was added to make a total quantity of | 196.0 ml. |
| S-A3 | |
| Silver nitrate | 83.2 g |
| Water was added to make a total quantity of | 196.0 ml. |
| G-A3 | |
| Low molecular gelatin | 36.8 g |
| Water was added to make a total quantity of | 343.0 ml. |

TABLE 7

| Emulsion | Silver iodide content (mol %) Core | Shell | Surface phase | Average silver iodide content (mol %) |
|---|---|---|---|---|
| EM-A | 25 (22.6) | 5 (68.0) | 3 (5.5) | 9.3 |
| EM-B | 25 (22.6) | 5 (68.0) | 8 (5.5) | 9.6 |
| EM-C | 5 (68.0) | 25 (22.6) | 8 (5.5) | 9.6 |
| EM-D | 25 (68.0) | 5 (22.6) | 12 (5.5) | 9.8 |
| EM-E | 18 (68.0) | 5 (22.6) | 12 (5.5) | 8.2 |
| EM-F | 20 (31.7) | 0 (53.1) | 10 (11.3) | 7.6 |
| EM-G | 13 (31.7) | 5 (53.1) | 10 (11.3) | 8.0 |
| EM-H | 22 (28.2) | 4 (34.0) | 8 (34.0) | 10.4 |
| EM-I | 22 (28.2) | 8 (34.0) | 4 (34.0) | 10.4 |

Figures in parentheses are values for the ratio of the phase in each grain, calculated as silver (%)

Preparation of silver halide photographic light-sensitive material samples

The emulsions EM-A through EM-I were each subjected to optimum gold/sulfur sensitization and spectral sensitization and processed in the same manner as in Example 1 to yield samples A through I.

Each sample was subjected to exposure, processing and determination of fogging and sensitivity in the same manner as in Example 1 except that the color development time was varied at two levels of 2 minutes 45 seconds and 3 minutes 15 seconds. The color development for 2 minutes 45 seconds is referred to as process I, and the color development for 3 minuets 15 seconds is referred to as process II. The procedures after color development were the same as in Example 1.

The measurements with green light are shown in Table 8. Relative fogging is expressed in percent ratio to the value for $D_{min}$ of sample A as subjected to process II. Relative sensitivity is expressed in percent ratio to the sensitivity of sample A as subjected to process II.

TABLE 8

| Sample | Emulsion | Process I Sensitivity | Process II Sensitivity | Process II Fog |
|---|---|---|---|---|
| Sample A | EM-A | 99 | 100 | 100 |
| Sample B | EM-B | 138 | 140 | 88 |
| Sample C | EM-C | 51 | 82 | 76 |
| Sample D | EM-D | 133 | 136 | 83 |
| Sample E | EM-E | 127 | 128 | 85 |
| Sample F | EM-F | 130 | 133 | 92 |
| Sample G | EM-G | 83 | 85 | 89 |
| Sample H | EM-H | 117 | 121 | 84 |
| Sample I | EM-I | 92 | 95 | 87 |

Measurements with red light or blue light gave results similar to those shown in Table 8.

Example 4

Preparation of hexagonally tabular silver iodobromide emulsion EM-A2

A hexagonally tabular silver iodobromide emulsion was prepared, using tabular silver iodobromide grains having an average circle-equivalent diameter of 0.70 μm, an aspect ratio of 3 and a silver iodide content of 20 mol% as seed crystals.

While vigorously stirring the solution G-10 in the reactor at a temperature of 65° C., a pAg of 9.7 and a pH of 6.8, the seed emulsion was added in an amount equivalent to 1.57 mol.

Then, the solutions H-10 and S-10 were added to the reactor at increasing flow rates at a constant molar ratio of 1 to 1 over a period of 58 minutes.

During formation of the grains, the pAg and pH were controlled by adding an aqueous solution of potassium bromide and an aqueous solution of potassium hydroxide to the reactor.

After formation of the grains, the mixture was washed by the conventional flocculation method, after which it was re-dispersed in gelatin (average molecular weight = 100000) and adjusted to a pH of 5.8 and a pAg of 8.06 at 40° C.

The resulting emulsion was a monodispersed emulsion comprising hexagonally tabular silver iodobromide grains having an average circle-equivalent diameter of 1.38 μm, an average aspect ratio of 4, a distribution width of 13.8% and a silver iodide content of 8.5 mol%. This emulsion is referred to as EM-A2.

Preparation of hexagonally tabular silver iodobromide emulsion EM-B2

An emulsion EM-B2 was prepared in the same manner as with the emulsion EM-A2 except that 1-ascorbic acid as a reducing agent was added in an amount of $5\times10^{-3}$ mol to the reactor before adding the reaction solution.

The resulting emulsion was a monodispersed emulsion comprising hexagonally tabular silver iodobromide grains having an average circle-equivalent diameter of 1.38 μm, a distribution width of 13.8% and a silver iodide content of 8.5 mol%.

Preparation of hexagonally tabular silver iodobromide emulsion EM-C2

An emulsion EM-C2 was prepared in the same manner as with the emulsion EM-A2 except that the halide solutions added were changed as follows. The solution H-10 in a 96.4% amount was used to form the low iodide phase and then the solution H-11 was added instead to form the surface phase.

The resulting emulsion was a monodispersed emulsion comprising hexagonally tabular silver iodobromide grains having an average circle-equivalent diameter of 1.38 μm, a distribution width of 14.0% and a silver iodide content of 8.8 mol%.

Preparation of hexagonally tabular silver iodobromide emulsion EM-D2

An emulsion EM-D2 was prepared in the same manner as with the emulsion EM-C2 except that 1-ascorbic acid as a reducing agent was added in an amount of $5\times10^{-3}$ mol to the reactor before adding the reaction solution.

The resulting emulsion was a monodispersed emulsion comprising hexagonally tabular silver iodobromide grains having an average circle-equivalent diameter of 1.38 μm, a distribution width of 14.0% and a silver iodide content of 8.8 mol%.

Preparation of hexagonally tabular silver iodobromide emulsion EM-E2

A hexagonally tabular silver iodobromide emulsion was prepared, using tabular silver iodobromide grains having an average circle-equivalent diameter of 0.70 μm, an aspect ratio of 3 and a silver iodide content of 20 mol% as seed crystals.

While vigorously stirring the solution G-10 in the reactor at a temperature of 65° C., a pAg of 9.7 and a pH of 6.8, the seed emulsion was added in an amount equivalent to 1.57 mol. Prior to addition of the fine grain emulsion, $5\times10^{-3}$ mol of 1-ascorbic acid and 7.26 mol of ammonium acetate as reducing agents were added to the reactor. Then, crystals were grown by continuously supplying the fine grain emulsion directly to the reactor from a mixing vessel for fine silver halide grain preparation placed near the reactor.

The solutions G-20, H-20 and S-20 were added to the mixing vessel at increased flow rates under increased pressured by the triple jet method over a period of 84 minutes. The fine grain emulsion in an amount according to the amount of reaction solution added was continuously supplied from the mixing vessel to the reactor.

Next, the solutions G-21, H-21 and S-21 were added in the same manner as above over a period of 11 minutes.

During this addition, the mixing vessel was kept at an impeller blade rotation ratio of 4000 rpm and a temperature of 30° C. The grain size of the fine grains supplied to the reactor fluctuated over the range of 0.01 to 0.02 μm.

During formation of the grains, the pAg and pH were controlled by adding an aqueous solution of potassium bromide and an aqueous solution of potassium hydroxide to the reactor.

After formation of the grains, the mixture was washed by the conventional flocculation method, after which it was dispersed in gelatin (average molecular weight = 100000) and adjusted to a pH of 5.8 and a pAg of 8.06 at 40° C.

The resulting emulsion was a monodispersed emulsion comprising hexagonally tabular silver iodobromide grains having an average grain size of 1.38 μm, a distribution width of 13.1% and a silver iodide content of 8.8 mol%. This emulsion is referred to as EM-E2.Preparation of hexagonally tabular silver iodobromide emulsion EM-F2

A hexagonally tabular silver iodobromide emulsion was prepared, using tabular silver iodobromide grains having an average circle-equivalent diameter of 0.70 μm, an aspect ratio of 3 and a silver iodide content of 20 mol% as seed crystals.

While vigorously stirring the solution G-10 in the reactor at a temperature of 65° C, a pAg of 9.7 and a pH of 6.8, the seed emulsion was added in an amount equivalent to 1.57 mol. Prior to addition of the fine grain emulsion, $5\times 10^{-3}$ mol of 1-ascorbic acid and 7.26 mol of ammonium acetate as reducing agents were added to the reactor. Then, the solutions G-20, H-20 and S-20 were added to a mixing vessel for fine silver halide grain preparation placed near the reactor at constant flow rate by the triple jet method to continuously form a fine grain emulsion. The fine grain emulsion thus formed was continuously supplied to the accumulation tank. When a given amount of the fine grain emulsion was accumulated in the accumulation tank, it was added to the reactor from the accumulation tank at increased flow rates over a period of 84 minutes.

Next, the solutions G-21, H-21 and S-21 were added in the same manner as above over a period of 11 minutes.

During this addition, the mixing vessel was kept at an impeller blade rotation rate of 4000 rpm and a temperature of 30° C. The accumulation tank was kept at a temperature of 20° C. The grain size of the fine grains supplied to the reactor was constant at 0.01 μm.

During formation of the grains, the pAg and pH were controlled by adding an aqueous solution of potassium bromide and an aqueous solution of potassium hydroxide to the accumulation tank to control the pAg and pH of the fine grain emulsion supplied to the reactor.

After formation of the grains, the mixture was washed by the conventional flocculation method, after which it was dispersed in gelatin (average molecular weight = 100000) and adjusted to a pH of 5.8 and a pAg of 8.06 at 40° C.

The resulting emulsion was a monodispersed emulsion comprising hexagonally tabular silver iodobromide grains having an average grain size of 1.38 μm, a distribution width of 12.5% and a silver iodide content of 8.8 mol%. This emulsion is referred to as EM-F2.

Preparation of hexagonally tabular silver iodobromide emulsion EM-G2

An emulsion EM-G2 was prepared in the same manner as with the emulsion EM-D2 except that tabular silver iodobromide grains having a silver iodide content of 12 mol% were used as seed crystals.

The resulting emulsion was a monodispersed emulsion comprising hexagonally tabular silver iodobromide grains having an average circle-equivalent diameter of 1.38 μm, a distribution width of 13.6% and a silver iodide content of 7.3 mol%.

Preparation of hexagonally tabular silver iodobromide emulsion EM-H2

An emulsion EM-H2 was prepared in the same manner as with the emulsion EM-D2 except that tabular silver iodobromide grains having a silver iodide content of 8 mol% were used as seed crystals.

The resulting emulsion was a monodispersed emulsion comprising hexagonally tabular silver iodobromide grains having an average circle-equivalent diameter of 1.38 μm, a distribution width of 13.5% and a silver iodide content of 6.6 mol%.

Preparation of hexagonally tabular silver iodobromide emulsion EM-I2

An emulsion EM-I2 was prepared in the same manner as with the emulsion EM-B except that tabular silver iodobromide grains having a silver iodide content of 8 mol% were used as seed crystals. Also, the solution H-30 was used to add the halide.

The resulting emulsion was a monodispersed emulsion comprising hexagonally tabular silver iodobromide grains having an average circle-equivalent diameter of 1.29 μm, a distribution width of 14.4% and a silver iodide content of 11.3 mol%.

The emulsions EM-A2 through EM-I2 thus obtained are summarized in Table 9.

| | | |
|---|---|---|
| G-10 | | |
| | Ossein gelatin (average molecular weight = 100000) | 120.0 g |
| | Compound I | 25.0 ml |
| | 28% aqueous ammonia | 440.0 ml |
| | 56% aqueous solution of acetic acid | 660.0 ml |
| | Water was added to make a total quantity of | 4000.0 ml. |
| Compound I: 10% aqueous ethanol solution of sodium salt of polyisopropylene-polyethyleneoxy-disuccinate | | |
| H-10 | | |
| | Potassium bromide | 812.2 g |
| | Potassium iodide | 72.3 g |
| | Water was added to make a total quantity of | 2074.3 ml. |
| S-10 | | |
| | Silver nitrate | 1233.3 g |
| | 28% aqueous ammonia Equivalent amount | |
| | Water was added to make a total quantity of | 2074.3 ml. |
| H-11 | | |
| | Potassium bromide | 26.3 g |
| | Potassium iodide | 6.5 g |
| | Water was added to make a total quantity of | 74.3 ml. |
| G-20 | | |
| | Ossein gelatin (average molecular weight = 40000) | 300.0 g |
| | Water was added to make a total quantity of | 2000.0 ml. |
| H-20 | | |
| | Potassium bromide | 783.1 g |

-continued

| | | |
|---|---|---|
| | Potassium iodide | 69.7 g |
| | Water was added to make a total quantity of | 2000.0 ml. |
| S-20 | | |
| | Silver nitrate | 1189.1 g |
| | Water was added to make a total quantity of | 2000.0 ml. |
| G-21 | | |
| | Ossein gelatin (molecular weight = 40000) | 11.1 g |
| | Water was added to make a total quantity of | 74.3 ml. |
| H-21 | | |
| | Potassium bromide | 26.3 g |
| | Potassium iodide | 6.5 g |
| | Water was added to make a total quantity of | 74.3 ml. |
| S-21 | | |
| | Silver nitrate | 44.2 g |
| | Water was added to make a total quantity of | 74.3 ml. |
| H-30 | | |
| | Potassium bromide | 760.3 g |
| | Potassium iodide | 144.6 g |
| | Water was added to make a total quantity of | 2074.3 ml. |

TABLE 9

| Emulsion | Silver iodide content (mol %) Core | Shell | Surface phase | Average silver iodide content (mol %) |
|---|---|---|---|---|
| EM-A2 | 20 (17.8) | 6 (82.2) | — | 8.5 |
| EM-B2 | 20 (17.8) | 6 (82.2) | — | 8.5 |
| EM-C2 | 20 (17.8) | 6 (79.3) | 15 (2.9) | 8.8 |
| EM-D2 | 20 (17.8) | 6 (79.3) | 15 (2.9) | 8.8 |
| EM-E2 | 20 (17.8) | 6 (79.3) | 15 (2.9) | 8.8 |
| EM-F2 | 20 (17.8) | 6 (79.3) | 15 (2.9) | 8.8 |
| EM-G2 | 12 (17.8) | 6 (79.3) | 15 (2.9) | 7.3 |
| EM-H2 | 8 (17.8) | 6 (79.3) | 15 (2.9) | 6.6 |
| EM-I2 | 8 (17.8) | 12 (79.3) | 15 (2.9) | 11.3 |

Note:
Figures in parentheses are values for the ratio of the portion in each grain, calculated as silver (%).

Preparation of silver halide photographic light-sensitive material samples

To the emulsions EM-A2 through EM-I2 were added an aqueous solution of ammonium thiocyanate, an aqueous solution of chloroauric acid tetrahydrate and an aqueous solution of sodium thiosulfate dihydrate, and each emulsion was subjected to a conventional chemical sensitization process at 55° C. optimally for exposure for $1\times10^{-2}$ second.

After completion of ripening, a methanol solution of the following two kinds of sensitizing dyes 1 and 2 was added to these emulsions so that the amount of dyes became 200 mg per mol of silver halide, followed by stirring at 46° C. for 10 minutes. Then, 4-hydroxy-6-methyl-1,3,3a, 7-tetrazaindene and 1-phenyl-5-mercaptotetrazole were added, and the following coupler dispersions along with an ordinary extender and hardener were added. This mixture was coated and dried on a triacetate base to an amount of silver coated of 15 mg/dm$^2$ to yield samples A2 through I2.

Sensitizing dye 1: Pyridinium salt of anhydro-3,5'-dichloro-3,3'-di (3-sulfopropyl)-9-ethylthiacarbocyaninehydroxide Sensitizing dye 2: Triethylamine salt of anhydro-9-ethyl-3,3'-di(3-sulfopropyl)-4,5,4',5'-dibenzothiacarbocyaninehydroxide Coupler dispersions (equivalent to 1 mol of silver halide) C-1

| | |
|---|---|
| C-1 | |
| The following coupler 1 | 28.3 g |
| Tricresyl phosphate | 67.1 g |
| Ethyl acetate | 268 ml |
| C-2 | |
| Gelatin | 67.1 g |
| 5% aqueous solution of Alkanol X (produced by Du-Pont) | 215 ml |

Water was added to make a total quantity of 1342 ml.

The above coupler dispersions C-1 and C-2 were mixed and ultrasonically dispersed before use.

Coupler 1

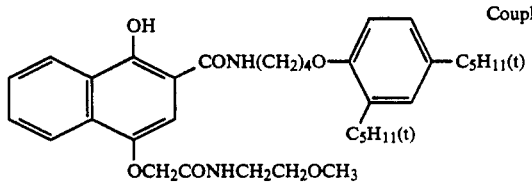

The samples thus prepared were each subjected to exposure through an optical wedge and a Toshiba glass filter Y-48 for 1 second, $1\times10^{-2}$ second or $1\times10^{-4}$ second using a light source with a color temperature of 5400° K. and then processed as follows.

| | | |
|---|---|---|
| 1. Color development | 1 minute 45 seconds | 38.0 ± 0.1° c. |
| 2. Bleaching | 6 minutes 30 seconds | 38.0 ± 3.0° C. |
| 3. Washing | 3 minutes 15 seconds | 24 to 41° C. |
| 4. Fixation | 6 minutes 30 seconds | 38.0 ± 3.0° C. |
| 5. Washing | 3 minutes 15 seconds | 24 to 41° C. |
| 6. Stabilization | 3 minutes 15 seconds | 38.0 ± 3.0° C. |
| 7. Drying | Under 50° C. | |

The processing solutions used in the respective processes were the same as in Example 1.

Each obtained sample was subjected to sensitometric determination (characteristic curve) immediately after its preparation. The results are shown in Table 10.

Relative fogging, or the relative value for minimum density ($D_{min}$), is expressed in percent ratio to the value for $D_{min}$ obtained from sample A as subjected to exposure for $1\times10^{-2}$ second.

Relative sensitivity, or the relative value for the reciprocal of the exposure amount which gives a density of $D_{min}+0.15$, is expressed in percent ratio to the sensitivity of sample A as subjected to exposure for $1\times10^{-2}$ second Relative gamma value, or the relative value for the gradient of the characteristic curve between the exposure amount which gives a density of $D_{min}+0.30$ and the exposure amount 10 (1.5) times that exposure amount, is expressed in percent ratio to the gamma value obtained from the sample as subjected to exposure for $1\times10^{-2}$ second.

TABLE 10

| Sample | Emulsion | Exposure for 1 second | | Exposure for $1 \times 10^{-2}$ second | | Exposure for $1 \times 10^{-4}$ second | |
|---|---|---|---|---|---|---|---|
| | | Sensitivity | Relative gamma value | Sensitivity | Relative gamma value | Sensitivity | Relative gamma value |
| Sample A2 | EM-A2 | 53 | 119 | 100 | 100 | 56 | 89 |
| Sample B2 | EM-B2 | 58 | 122 | 116 | 97 | 62 | 91 |
| Sample C2 | EM-C2 | 136 | 116 | 219 | 131 | 122 | 93 |
| Sample D2 | EM-D2 | 214 | 108 | 232 | 127 | 216 | 96 |
| Sample E2 | EM-E2 | 231 | 106 | 255 | 119 | 242 | 98 |
| Sample F2 | EM-F2 | 253 | 105 | 268 | 113 | 255 | 98 |
| Sample G2 | EM-G2 | 163 | 109 | 187 | 125 | 167 | 95 |
| Sample H2 | EM-H2 | 81 | 113 | 127 | 124 | 93 | 92 |
| Sample I2 | EM-I2 | 41 | 128 | 95 | 89 | 46 | 88 |

As is evident from Table 10, the light-sensitive materials incorporating a reduction sensitized silver halide emulsion showed reduced fluctuation in sensitivity and tone upon change in exposure intensity, i.e., the reciprocity law failure property was improved. Especially, the light-sensitive materials incorporating an emulsion of the present invention (EM-E or EM-F) showed higher sensitivity and a further improved reciprocity law failure property.

What is claimed is:

1. A silver halide emulsion comprising a dispersing medium and light-sensitive silver halide grains wherein said silver halide grains each comprise:

(a) a high silver iodide-containing phase having a silver iodide content of not less than 15 mol% in the internal portion, (b) a low silver iodide-containing phase locating outside the phase (a) and having a silver iodide content lower than that of the phase (a), and (c) a surface phase having a silver iodide content higher than that of an inner phase adjacent thereto, and wherein a part or all of the phase (c) and a part or all of the phase (a) or the phase (b) are formed by supplying a fine silver halide grain emulsion prepared in the presence of protective colloid.

2. A silver halide emulsion of claim 1 wherein the phase (a) has a silver iodide content of 20 to 45 mol%.

3. A silver halide emulsion of claim 1 wherein the phase (b) has a silver iodide content of not more than 15 mol%.

4. A silver halide emulsion of claim 1 wherein the silver iodide content of the phase (c) is higher by not less than 2 mol% than that of the inner phase adjacent thereto.

5. A silver halide emulsion of claim 1 wherein said silver halide emulsion comprises silver iodobromide grains containing 1 to 20 mol% iodide.

6. A silver halide emulsion of claim 1 wherein a part or all of the phases (c) and (a) are formed by supplying said fine silver halide grain emulsion.

7. A silver halide emulsion of claim 6 wherein said fine silver halide grain emulsion has a grain size of not more than 0.1 μm.

8. A silver halide emulsion of claim 1 wherein said silver halide emulsion is spectrally sensitized using a sensitizing dye selected from the group consisting of monomethine and trimethine cyanine dyes.

9. A silver halide emulsion of claim 1 wherein said silver halide grains are reduction-sensitized by adding a reducing agent.

10. A silver halide emulsion of claim 9 wherein said silver halide grains are, after being reduction-sensitized, oxidation-treated by adding an oxidizing agent.

11. A silver halide color photographic light-sensitive material comprising a support having thereon a blue-sensitive layer, a green-sensitive layer and a red-sensitive layer wherein at least one of the layers comprises a silver halide emulsion as claimed in claim 1.

12. A method of preparing a silver halide emulsion comprising silver halide grains wherein said silver halide grains each comprise (a) a high silver iodide-containing phase having a silver iodide content of not less than 15 mol% in the internal portion; (b) a low silver iodide-containing phase which locates outside the phase (a) and has a silver iodide content lower than that of the phase (a); and (c) a surface phase whose iodide content is higher than that of an inner phase adjacent thereto;

comprising forming a part or all of the phase (c) and a part or all of the phase (a) or the phase [b) by supplying an emulsion comprising fine silver halide grains formed in the presence of protective colloid.

13. A method of claim 12, wherein said emulsion comprising fine silver halide grains is supplied immediately after said emulsion comprising fine silver halide grains has been formed.

14. A method of claim 12, wherein said emulsion comprising fine silver halide grains is supplied after said emulsion comprising fine silver halide grains has been formed and reserved for a period of time.

* * * * *